US009811010B2

(12) United States Patent
Niida et al.

(10) Patent No.: US 9,811,010 B2
(45) Date of Patent: Nov. 7, 2017

(54) ELECTROPHOTOGRAPHIC PHOTOSENSITIVE MEMBER, PROCESS CARTRIDGE, AND IMAGE FORMING APPARATUS

(71) Applicant: FUJI XEROX CO., LTD., Tokyo (JP)

(72) Inventors: Yasuhiro Niida, Kanagawa (JP); Kazuyuki Tada, Kanagawa (JP); Jiro Korenaga, Kanagawa (JP); Yukimi Kawabata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/016,350

(22) Filed: Feb. 5, 2016

(65) Prior Publication Data

US 2017/0052464 A1 Feb. 23, 2017

(30) Foreign Application Priority Data

Aug. 19, 2015 (JP) ..... 2015-161912

(51) Int. Cl.

| | |
|---|---|
| ***G03G 5/06*** | (2006.01) |
| ***G03G 5/043*** | (2006.01) |
| ***G03G 15/00*** | (2006.01) |
| *G03G 21/18* | (2006.01) |

(52) U.S. Cl.

CPC ..... *G03G 5/043* (2013.01); *G03G 5/0607* (2013.01); *G03G 15/75* (2013.01); *G03G 21/18* (2013.01); *G03G 21/1814* (2013.01)

(58) Field of Classification Search

CPC ..... G03G 5/04; G03G 5/043; G03G 5/0607
USPC ..... 430/56, 72
See application file for complete search history.

(56) References Cited

U.S. PATENT DOCUMENTS

| | | | | |
|---|---|---|---|---|
| 5,637,142 | A | 6/1997 | Kubo et al. | |
| 8,785,090 | B2 | 7/2014 | Yamano et al. | |
| 2008/0160439 | A1* | 7/2008 | Yokota | G03G 15/751 430/69 |

FOREIGN PATENT DOCUMENTS

| | | | |
|---|---|---|---|
| JP | 2002-139851 | A | 5/2002 |
| JP | 4251662 | B2 | 4/2009 |
| JP | 2012-247497 | A | 12/2012 |
| JP | 2012-247498 | A | 12/2012 |
| JP | 2012-247614 | A | 12/2012 |
| JP | 2013-231867 | A | 11/2013 |
| WO | 2008/053904 | A1 | 5/2008 |

* cited by examiner

*Primary Examiner* — Janis L Dote
(74) *Attorney, Agent, or Firm* — Sughrue Mion, PLLC

(57) ABSTRACT

An electrophotographic photosensitive member includes a conductive base and a single-layer-type photosensitive layer on the conductive base. The photosensitive layer contains a binder resin, a charge generation material, a hole transport material, a fluorine-atom-containing electron transport material, and fluorine-atom-containing resin particles. An amount of the charge generation material in the photosensitive layer is 0.5% by weight or more and less than 2.0% by weight. The charge generation material has a distribution that satisfies Formula (1): $30 \leq a/b$ in a thickness direction of the photosensitive layer where a and b are as defined in the specification, and b may be 0. The fluorine-atom-containing electron transport material has a distribution that satisfies Formula (2): $30 \leq c/d$ in the thickness direction of the photosensitive layer where c and d are as defined in the specification, and d may be 0.

9 Claims, 5 Drawing Sheets

ELECTROPHOTOGRAPHIC PHOTOSENSITIVE MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-161912 filed Aug. 19, 2015.

BACKGROUND (i) Technical Field

The present invention relates to an electrophotographic photosensitive member, a process cartridge, and an image forming apparatus.

(ii) Related Art

According to a typical electrophotographic image forming apparatus, a toner image that has been formed on a surface of an electrophotographic photosensitive member through a process that includes charging, electrostatic latent image forming, and developing is transferred onto a recording medium.

SUMMARY

According to an aspect of the invention, there is provided an electrophotographic photosensitive member that includes a conductive base and a single-layer-type photosensitive layer on the conductive base. The photosensitive layer contains a binder resin, a charge generation material, a hole transport material, a fluorine-atom-containing electron transport material, and fluorine-atom-containing resin particles. An amount of the charge generation material in the photosensitive layer is 0.5% by weight or more and less than 2.0% by weight. The charge generation material has a distribution that satisfies Formula (1): $30 \leq a/b$ in a thickness direction of the photosensitive layer where a represents a concentration of the charge generation material in a region extending ⅓ of a thickness of the photosensitive layer from a surface side of the photosensitive layer, and b represents a concentration of the charge generation material in a region extending ⅔ of the thickness of the photosensitive layer from a conductive-base side of the photosensitive layer and may be 0. The fluorine-atom-containing electron transport material has a distribution that satisfies Formula (2): $30 \leq c/d$ in the thickness direction of the photosensitive layer where c represents a concentration of the fluorine-atom-containing electron transport material in the region extending ⅓ of the thickness of the photosensitive layer from the surface side of the photosensitive layer, and d represents a concentration of the fluorine-atom-containing electron transport material in the region extending ⅔ of the thickness of the photosensitive layer from the conductive-base side of the photosensitive layer and may be 0.

BRIEF DESCRIPTION OF THE DRAWINGS

Exemplary embodiments of the present invention will be described in detail based on the following figures, wherein.

DETAILED DESCRIPTION

Figure 1:
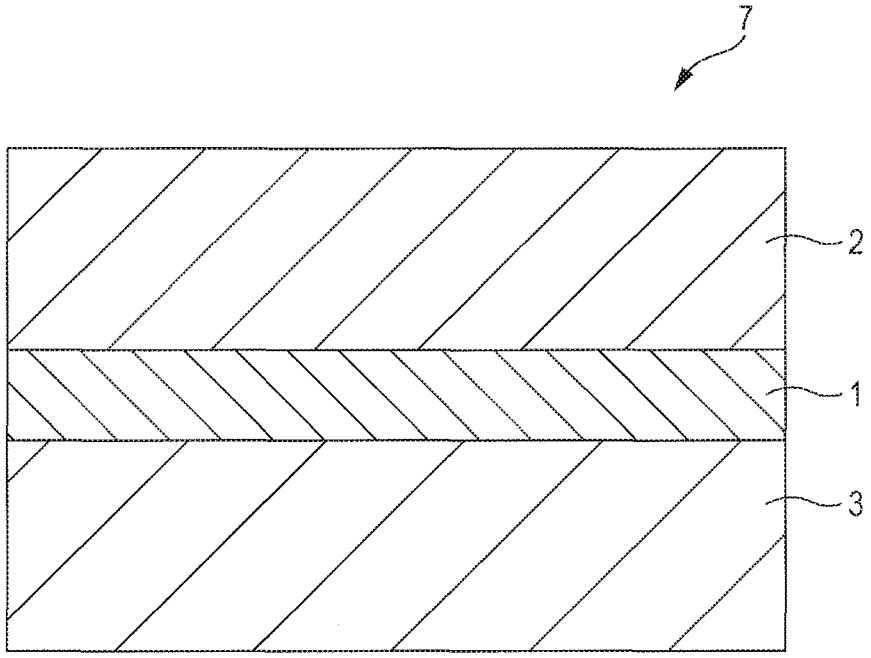
FIG. 1 is a schematic cross-sectional view illustrating a part of an electrophotographic photosensitive member according to an exemplary embodiment.

Exemplary embodiments of the present invention will now be described in detail.

Electrophotographic Photosensitive Member

An electrophotographic photosensitive member (hereinafter may be simply referred to as a "photosensitive member") according to an exemplary embodiment includes a conductive base and a positively chargeable organic photosensitive member disposed on the conductive base and including a single-layer-type photosensitive layer (hereinafter may be simply referred to as a "single-layer photosensitive member").

The single layer-type photosensitive layer (hereinafter may be simply referred to as a "photosensitive layer") contains a binder resin, a charge generation material, a hole transport material, a fluorine-atom-containing electron transport material (hereinafter may be referred to as a "fluorine-containing electron transport material"), and fluorine-atom-containing resin particles (hereinafter may be simply referred to as "fluororesin particles"). The amount of the charge generation material in the photosensitive layer is 0.5% by weight or more and less than 2.0% by weight. The charge generation material has a distribution that satisfies formula (1) in a thickness direction of the photosensitive layer:

$$30 \leq a/b \qquad \text{Formula (1):}$$

where a represents a concentration of the charge generation material in a region extending ⅓ of a thickness of the photosensitive layer from a surface side of the photosensitive layer, and b represents a concentration of the charge generation material in a region extending ⅔ of the thickness of the photosensitive layer from a conductive-base side of the photosensitive layer and may be 0. The fluorine-atom-containing electron transport material has a distribution that satisfies formula (2) in the thickness direction of the photosensitive layer:

$$30 \leq c/d \qquad \text{Formula (2):}$$

where c represents a concentration of the fluorine-atom-containing electron transport material in the region extending ⅓ of the thickness of the photosensitive layer from the surface side of the photosensitive layer, and d represents a concentration of the fluorine-atom-containing electron transport material in the region extending ⅔ of the thickness of the photosensitive layer from the conductive-base side of the photosensitive layer and may be 0.

The single-layer-type photosensitive layer is a photosensitive layer that has a hole transport property and an electron transport property as well as a charge generation capability.

For the electrophotographic photosensitive member of this exemplary embodiment, the "amount of the charge generation material in the photosensitive layer" means the amount of the charge generation material relative to the entire photosensitive layer.

The "region extending ⅓ of the thickness of the photosensitive layer from the surface side" is a region that extends from the outermost surface side of the photosensitive layer toward the conductive base by a length equal to ⅓ of the thickness of the photosensitive layer.

The "region extending ⅔ of the thickness of the photosensitive layer from the conductive-base side" is a region that extends from the conductive-base side of the photosensitive layer toward the outermost surface of the photosensitive layer by a length equal to ⅔ of the thickness of the photosensitive layer, in other words, the region outside the region extending ⅓ of the thickness from the outermost surface side of the photosensitive layer.

The "number of the fluorine-atom-containing resin particles per unit cross-sectional area" refers to the number of fluororesin particles found at a cross section taken in the thickness direction of the photosensitive layer and is the number per square micrometer ($\mu m^2$).

From the viewpoint of production cost, etc., a single-layer-type photosensitive member has been used as the electrophotographic photosensitive member.

A single-layer-type photosensitive member has a single-layer-type photosensitive layer that contains a charge generation material, a hole transport material, and an electron transport material. It is the same layer that has light sensitivity and chargeability. In contrast, an organic photosensitive member having a multilayer-type photosensitive layer (this photosensitive member is hereinafter referred to as a multilayer photosensitive member) has light sensitivity and chargeability assigned to separate dedicated layers according to their functions. In this respect, in principle, a single-layer-type photosensitive member rarely achieves properties comparable to those of the multilayer photosensitive member in terms of chargeability and light sensitivity.

However, the electrophotographic photosensitive member of this exemplary embodiment exhibits high chargeability and high sensitivity owing to the above-described structure, namely, the controlled distribution of the charge generation material in the thickness direction of the single-layer-type photosensitive layer. The exact reason for this is not clear but can be assumed as follows.

For a single-layer photosensitive member, occurrence of excess charges (thermally excited carriers) in the photosensitive layer is to be suppressed as much as possible under dark conditions. Occurrence of thermally excited carriers in the photosensitive layer is suppressed by decreasing the amount of the charge generation material.

In order to obtain light sensitivity, a sufficient amount of generated charges, a hole transport capability, and an electron transport capability are desirably exhibited. For example, increasing the amount of the charge generation material (for example, 2.0% by weight or more) tends to improve light sensitivity. However, excessively increasing the amount of the charge generation material tends to decrease chargeability and thus the amount of the charge generation material is to be decreased from this perspective. However, excessively decreasing the amount of the charge generation material tends to decrease light sensitivity. For example, when the amount of the charge generation material in the photosensitive layer is 0.5% by weight or more and less than 2.0% by weight, a photosensitive member that achieves both high chargeability and high sensitivity is rarely obtained.

The transport capability of the electron transport material generally known as having the highest electron transport capability is about a few percent of the hole transport capability of a hole transport material. In the photosensitive layer, the electron transport capability is lower than the hole transport capability. Accordingly, in order to further improve light sensitivity of a single-layer photosensitive member, the electron transport distance is to be shortened.

When a photosensitive layer of a single-layer-type photosensitive member is irradiated with light, the charge generation material absorbs light and generates charges; thus, charges are more readily generated in the surface-side region of the photosensitive layer. When charges are readily generated, it becomes easier to shorten the electron transport distance. Shortening the electron transport distance presumably improves the electron transport capability and light sensitivity.

Thus, according to the electrophotographic photosensitive member of this exemplary embodiment, the charge generation material is caused to localize in the surface-side region of the single-layer-type photosensitive layer so that the charge generation material more effectively exhibits light sensitivity. In other words, because the charge generation material contained in the single-layer-type photosensitive layer is distributed in such a manner that the amount contained in the region extending ⅓ of the thickness from the surface side of the photosensitive layer is increased, an electrophotographic photosensitive member having high chargeability and high sensitivity can be obtained despite the fact that the amount of the charge generation material in the entire photosensitive layer is 0.5% by weight or more and less than 2.0% by weight.

It has also been found that the residual potential remaining in the single-layer-type photosensitive member after irradiation of the photosensitive layer with light may increase in some cases (in other words, the potential does not smoothly decrease in some cases).

Regarding this issue, according to the electrophotographic photosensitive member of the exemplary embodiment as described above, the distribution of the fluorine-containing electron transport material is controlled in the thickness direction of the single-layer-type photosensitive layer; thus, an electrophotographic photosensitive member having a low residual potential property can be obtained. The reason for this is not clear but is assumed to be as follows.

In a single-layer-type photosensitive member, light irradiating the photosensitive layer causes the charge generation material to generate charges, and the electrons migrate toward the surface side of the photosensitive layer through the electron transport material. Decreasing the electron transport distance presumably improves the electron transport capability and helps decrease the residual potential remaining in the photosensitive member However, in order to form a single-layer-type photosensitive member, the electron transport material is dissolved in a solvent to prepare a coating solution for forming a photosensitive layer, and thus has a tendency to disperse in all parts of the photosensitive layer during the process of forming the photosensitive layer. Accordingly, the electron transport material tends to be distributed in all parts of the photosensitive layer. For example, the electron transport material may be distributed in a high concentration in the base-side region of the photosensitive layer. In such a case, the electron transport distance is long, the electron transport capability of the photosensitive layer is easily degraded, and the residual potential of the photosensitive layer tends to be high.

In the electrophotographic photosensitive member of the exemplary embodiment, dispersion of the electron transport material into all parts of the single-layer-type photosensitive member is suppressed and distribution of the electron transport material in a high concentration in the base-side region of the photosensitive layer is suppressed so that the electron transport material is localized in the surface-side region of the photosensitive layer. As a result, the electron transport distance is decreased and the electron transport capability is easily improved.

In this exemplary embodiment, in order to have the electron transport material localized in the surface-side region of the single-layer-type photosensitive layer, a fluorine-containing electron transport material is used as the electron transport material and fluororesin particles are added to the photosensitive layer along with the fluorine-containing electron transport material. The fluorine-containing electron transport material contains fluorine atoms in the molecular structure. Thus, for example, the fluorine-containing electron transport material has a tendency to aggregate with fluororesin particles due to the affinity between the fluorine-atom-containing functional group (for example, a fluoroalkyl group) and fluororesin particles (for example, polytetrafluoroethylene resin). Since aggregates of the fluororesin particles are bulky, the aggregates do not readily disperse into all parts of the photosensitive layer during formation of the photosensitive layer and are not easily distributed in the conductive-base-side of the photosensitive layer. Accordingly, the fluorine-containing electron transport material forming the aggregates of the fluororesin particles is substantially prevented from becoming distributed in a high concentration in the conductive-base-side region of the photosensitive layer. As a result, the fluorine-containing electron transport material tends to be localized in the surface-side region of the photosensitive layer. Since the amount of the fluorine-containing electron transport material contained in the region extending ⅓ of thickness of the photosensitive layer from the surface side of the photosensitive layer is increased, degradation of the electron transport capability of the photosensitive layer is suppressed. The resulting photosensitive member presumably has a low residual potential property.

It can be presumed from the above description that an electrophotographic photosensitive member having a low residual potential property is obtained when the fluorine-containing electron transport material is localized in the surface-side region of the photosensitive layer, in other words, when the ratio c/d is 30 or more (when formula (2) is satisfied), where c represents the concentration of the fluorine-containing electron transport material in the region extending ⅓ of the thickness of the photosensitive layer from the surface side of the photosensitive layer and d represents the concentration of the fluorine-containing electron transport material in the region extending ⅔ of the thickness of the photosensitive layer from the conductive-base-side of the photosensitive layer.

As described above, according to the electrophotographic photosensitive member of the exemplary embodiment, the fluorine-containing electron transport material is localized in the surface-side region of the photosensitive layer along with the charge generation material. As a result, the electrophotographic photosensitive member of the exemplary embodiment has a low residual potential property, high chargeability, and high sensitivity. Thus, changes in electrical properties are suppressed in long-term use.

The electrophotographic photosensitive member according to the exemplary embodiment will now be described in detail with reference to the drawings.

FIG. 1 is a schematic cross-sectional view of a part of an electrophotographic photosensitive member 7 according to an exemplary embodiment.

The electrophotographic photosensitive member 7 includes, for example, a conductive base 3, and an undercoat layer 1 and a single-layer-type photosensitive layer 2 stacked on the conductive base 3 in that order.

The undercoat layer 1 is optional. That is, the single-layer-type photosensitive layer 2 may be directly disposed on the conductive base 3 or on the undercoat layer 1 on the conductive base 3.

If needed, an additional layer may be provided. Specifically, for example, a protective layer may be disposed on the single-layer-type photosensitive layer 2, if needed.

The individual layers of the electrophotographic photosensitive member of the exemplary embodiment will now be described in detail. In the description, reference numerals are omitted.

Conductive Base

Examples of the conductive base include metal plates, metal drums, and metal belts that contain metals (aluminum, copper, zinc, chromium, nickel, molybdenum, vanadium, indium, gold, platinum, etc.) or alloys (stainless steels etc.). Other examples of the conductive base include paper, resin films, and belts prepared by performing coating, vapor deposition, or laminating using conductive compounds (for example, conductive polymers and indium oxide), metals (for example, aluminum, palladium, and gold), or alloys. The term "conductive" means that the volume resistivity is less than $10^{13}$ Ωcm.

When the electrophotographic photosensitive member is used in a laser printer, the surface of the conductive base may be roughened so that the center-line average roughness Ra is 0.04 μm or more and 0.5 μm or less. This is to decrease interference fringes that occur during irradiation with a laser beam. When incoherent light is used as a light source, the surface roughening for preventing interference fringes is optional. However, surface roughening decreases occurrence of defects caused by irregularities on the surface of the conductive base and extends the service life.

Examples of the surface roughening technique include wet honing that involves spraying a suspension of an abrasive in water onto a conductive base, centerless grinding that involves pressing a conductive base against a rotating grinding stone to continuously perform grinding, and anodization.

Another example of the surface roughening technique does not involve directly roughening a surface of a conductive base; instead, the technique involves forming a layer on the surface of the conductive base by using a dispersion containing dispersed conductive or semi-conductive powder in a resin so that the rough surface is created by the particles dispersed in that layer.

The surface roughening by anodization involves anodizing a metal (for example, aluminum) conductive base serving as an anode in an electrolyte solution so as to form an oxide film on the surface of the conductive base. Examples of the electrolyte solution include a sulfuric acid solution and an oxalic acid solution. However, a porous anodic oxide film as is formed by anodization is chemically active and susceptible to contamination and undergoes large changes in resistance depending on the environment. Thus, the porous anodic oxide film may be subjected to a pore sealing treatment in which the fine pores of the oxide film are stopped by volume expansion caused by hydration reaction in pressurized water vapor or in boiling water (a metal salt such as a nickel salt may be added) so that the oxide is transformed into a more stable hydrous oxide.

The thickness of the anodic oxide film may be, for example, 0.3 μm or more and 15 μm or less. When the thickness is within this range, a barrier property tends to be exhibited against injection and the increase in residual potential caused by repeated use tends to be suppressed.

The conductive base may be treated with an acidic treatment solution or be subjected to a Boehmite treatment.

The treatment with an acidic treatment solution may be carried out as follows, for example. First, an acidic treatment solution containing phosphoric acid, chromic acid, and hydrofluoric acid is prepared. The blend ratios of the phosphoric acid, chromic acid, and hydrofluoric acid in the acidic treatment solution are, for example, phosphoric acid: 10% by weight or more and 11% by weight or less, chromic acid: 3% by weight or more and 5% by weight or less, hydrofluoric acid: 0.5% by weight or more and 2% by weight or less. The total concentration of all the acids may be in the range of 13.5% by weight or more and 18% by weight or less. The treatment temperature may be, for example, 42° C. or higher and 48° C. or lower. The thickness of the film may be 0.3 μm or more and 15 μm or less.

The Boehmite treatment is carried out by immersing the base in pure water at 90° C. or higher and 100° C. or lower for 5 to 60 minutes or by bringing the base in contact with heated water vapor at 90° C. or higher and 120° C. or lower for 5 to 60 minutes. The thickness of the film may be 0.1 μm or more and 5 μm or less. The treated base may be further subjected to an anodization treatment by using an electrolyte solution having a low film-dissolving property. Examples of the electrolyte here include adipic acid, boric acid, a borate, a phosphate, a phthalate, a maleate, a benzoate, a tartrate, and a citrate.

Undercoat Layer

The undercoat layer is, for example, a layer that contains inorganic particles and a binder resin.

Examples of the inorganic particles include those having powder resistance (volume resistivity) of $10^2$ Ωcm or more and $10^{11}$ Ωcm or less. Examples of the inorganic particles having such a resistivity include metal oxide particles such as tin oxide particles, titanium oxide particles, zinc oxide particles, and zirconium oxide particles. In particular, zinc oxide particles may be used.

The BET specific surface area of the inorganic particles measured may be, for example, 10 $m^2/g$ or more. The volume-average particle diameter of the inorganic particles may be, for example, 50 nm or more and 2000 nm or less (or may be 60 nm or more and 1000 nm or less).

The amount of the inorganic particles relative to the binder resin is, for example, 10% by weight or more and 80% by weight or less, and may be 40% by weight or more and 80% by weight or less.

The inorganic particles may be surface-treated. Two or more types of inorganic particles subjected to different surface treatments or having different particle diameters may be mixed and used.

Examples of the surface treatment agent include silane coupling agents, titanate-based coupling agents, aluminum-based coupling agents, and surfactants. Silane coupling agents are preferable, and amino-group-containing silane coupling agents are more preferable.

Examples of the amino-group-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used as a mixture. For example, an amino-group-containing silane coupling agent and another silane coupling agent may be used in combination. Examples of the this another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method using a surface treatment agent may be any known method and may be a dry or wet method.

The amount of the surface treatment agent used in the treatment may be 0.5% by weight or more and 10% by weight or less relative to the inorganic particles.

The undercoat layer may contain inorganic particles and an electron-accepting compound (acceptor compound) from the viewpoints of enhancing long-term stability of electrical characteristics and a carrier blocking property.

Examples of the electron-accepting compound include electron transport substances. Examples thereof include quinone-based compounds such as chloranil and bromanil; tetracyanoquinodimethane-based compounds; fluorenone compounds such as 2,4,7-trinitrofluorenone and 2,4,5,7-tetranitro-9-fluorenone; oxadiazole-based compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone-based compounds; thiophene compounds; and diphenoquinone compounds such as 3,3',5,5'-tetra-t-butyldiphenoquinone.

A compound having an anthraquinone structure may be used as the electron-accepting compound. Examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron-accepting compound may be contained in the undercoat layer by being co-dispersed with the inorganic particles or by being attached to the surfaces of the inorganic particles.

Examples of the method for attaching the electron-accepting compound onto the surfaces of the inorganic particles include a wet method or a dry method.

According to a dry method, for example, while inorganic particles are being stirred with a mixer having large shear force, an electron-accepting compound as is or as dissolved in an organic solvent is added thereto dropwise or sprayed along with dry air or nitrogen gas so that the electron-accepting compound attaches to the surfaces of the inorganic particles. Dropwise addition or spraying of the electron-accepting compound may be performed at a temperature not higher than the boiling point of the solvent. After dropwise addition or spraying of the electron-accepting compound, baking may be conducted at 100° C. or higher. Baking may be performed at any temperature for any length of time as long as electrophotographic properties are obtained.

According to a wet method, for example, while inorganic particles are being dispersed in a solvent by stirring or by using ultrasonic waves, a sand mill, an attritor, a ball mill, or the like, an electron-accepting compound is added thereto, and after stirring or dispersing, the solvent is removed to have the electron-accepting compound attach to the surfaces of the inorganic particles. Examples of the method for removing the solvent include filtration and distillation. Baking at 100° C. or higher may be conducted after the removal of the solvent. Baking may be performed at any temperature for any length of time as long as electrophotographic properties are obtained. In the wet method, water contained in the inorganic particles may be removed prior to adding the electron-accepting compound. For example, the inorganic particles may be stirred and heated in a solvent to remove water or water may be azeotropically removed with a solvent.

Attaching the electron-accepting compound may be performed before, after, or simultaneously with performing the surface treatment on the inorganic particles by using a surface treatment agent.

The amount of the electron-accepting compound relative to the inorganic particles is, for example, 0.01% by weight or more and 20% by weight or less and may be 0.01% by weight or more and 10% by weight or less.

Examples of the binder resin used in the undercoat layer include known polymer materials such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; and other known materials such as zirconium chelate compounds, titanium chelate compounds, aluminum chelate compounds, titanium alkoxide compounds, organic titanium compounds, and silane coupling agents. Other examples of the binder resin used in the undercoat layer include charge transport resins having charge transport groups and conductive resins (for example, polyaniline).

Among these, a resin insoluble in the coating solvent contained in the overlying layer may be used as the binder resin contained in the undercoat layer. Examples thereof include thermosetting resins such as urea resins, phenolic resins, phenol-formaldehyde resins, melamine resins, urethane resins, unsaturated polyester resins, alkyd resins, and epoxy resins; and resins obtained by reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin. When two or more of these binder resins are used in combination, the mixing ratio is set as desired.

The undercoat layer may contain various additives that improve electrical properties, environmental stability and image quality. Examples of the additives include known materials such as electron transport pigments based on fused polycyclic and azo materials, zirconium chelate compounds, titanium chelate compounds, aluminum chelate compounds, titanium alkoxide compounds, organic titanium compounds, and silane coupling agents. Although a silane coupling agent is used in a surface treatment of inorganic particles as discussed above, it may also be added to the undercoat layer as an additive.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compound include zirconium butoxide, zirconium ethyl acetoacetate, zirconium triethanolamine, zirconium acetylacetonate butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butyrate, diethylacetoacetate aluminum diisopropylate, and aluminum tris(ethyl acetoacetate).

These additives may be used alone, as a mixture of two or more compounds, or as a polycondensation product of two or more compounds.

The undercoat layer may have a Vickers hardness of 35 or more. In order to suppress Moire-images, the surface roughness (ten point average roughness) of the undercoat layer may be adjusted to be in the range of $1/(4n)\lambda$ to $(1/2)\lambda$ where $\lambda$ represents the wavelength of the laser used for exposure and n represents the refractive index of the overlying layer.

Resin particles and the like may be added to the undercoat layer to adjust the surface roughness. Examples of the resin particles include silicone resin particles, and crosslinked polymethyl methacrylate resin particles. The surface of the undercoat layer may be polished to adjust the surface roughness. Examples of the polishing technique include buff polishing, sand blasting, wet honing, and grinding.

The undercoat layer may be formed by any known method. For example, a coating solution for forming an undercoat layer may be prepared by adding the above-described components to a solvent and applied to form a coating film, and the coating film may be dried, and if desirable, heated.

A known organic solvent may be used as the solvent for preparing the coating solution for forming the undercoat layer. Examples of the known organic solvent include alcohol-based solvents, aromatic hydrocarbon solvents, halogenated hydrocarbon solvents, ketone-based solvents, ketone alcohol-based solvents, ether-based solvents, and ester-based solvents.

Specific examples of these solvents include methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the technique for dispersing inorganic particles in preparing the coating solution for forming the undercoat layer include known techniques that use a roll mill, a ball mill, a vibrating ball mill, an attritor, a sand mill, a colloid mill, and a paint shaker.

Examples of the technique for applying the coating solution for forming the undercoat layer onto the conductive base include known techniques such as a blade coating technique, a wire bar coating technique, a spray coating technique, a dip coating technique, a bead coating technique, an air knife coating technique, and a curtain coating technique.

The thickness of the undercoat layer is, for example, 15 μm or more and may be in the range of 20 μm or more and 50 μm or less.

Intermediate Layer

An intermediate layer may be further provided between the undercoat layer and the photosensitive layer although this is not illustrated in the drawings. The intermediate layer is, for example, a layer containing a resin. Examples of the resin used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organic metal compound. Examples of the organic metal compound used in the intermediate layer include those which contain metal atoms such as zirconium, titanium, aluminum, manganese, and silicon atoms. The compounds used in the intermediate layer may be used alone, as a mixture of two or more compounds, or as a polycondensation product of two or more compounds.

In particular, the intermediate layer may be a layer that contains an organic metal compound that contains a zirconium atom or a silicon atom.

The intermediate layer may be formed by any known method. For example, a coating solution for forming the intermediate layer may be prepared by adding the above-described components to a solvent and applied to form a coating film, and the coating film may be dried and, if desired, heated. Examples of the technique for applying the solution for forming the intermediate layer include known techniques such as a dip coating technique, a lift coating technique, a wire bar coating technique, a spray coating technique, a blade coating technique, a knife coating technique, and a curtain coating technique.

The thickness of the intermediate layer may be set within the range of 0.1 μm or more and 3 μm or less. The intermediate layer may also serve as an undercoat layer.

Single-layer-type Photosensitive Layer

As mentioned above, the charge generation material and the fluorine-containing electron transport material contained in the single-layer-type photosensitive layer of the exemplary embodiment are localized in the surface-side region of the photosensitive layer in the thickness direction. The charge generation material and the fluorine-containing electron transport material are distributed in such a manner that the formula $30 \leq a/b$ representing the distribution of the charge generation material in the thickness direction of the photosensitive layer and the formula $30 \leq c/d$ representing the distribution of the fluorine-containing electron transport material in the thickness direction of the photosensitive layer are satisfied.

The fluororesin particles contained in the single-layer-type photosensitive layer are localized in the surface-side region of the photosensitive layer in the thickness direction. The fluororesin particles may be distributed so as to satisfy the formula $30 \leq e/f$ representing the distribution of the fluororesin particles in the thickness direction of the photosensitive layer, where e represents the number of the fluorine-atom-containing resin particles per unit cross-sectional area in the region extending ⅓of the thickness of the photosensitive layer from the surface side of the photosensitive layer, and f represents the number of the fluorine-atom-containing resin particles per unit cross-sectional area in the region extending ⅔of the thickness of the photosensitive layer from the conductive-base side of the photosensitive layer and may be 0.

In the single-layer-type photosensitive layer of the exemplary embodiment, no clear interface is formed in view of the low residual potential property at the border between the surface-side region where the charge generation material and the fluorine-containing electron transport material are abundant and the conductive-base-side region where the charge generation material and the fluorine-containing electron transport material are less abundant. When b is 0 and d is 0, there occur a surface-side region where the charge generation material and the fluorine-containing electron transport material are present and a conductive-base-side region where the charge generation material and the fluorine-containing electron transport material are absent. In this case also, no clear interface is bound at the border between the two regions.

A typical multilayer-type photosensitive layer known in the art includes a charge generation layer that contains a charge generation material and a charge transport layer that contains no charge generation material but a charge transport material such as an electron transport material, and a clear interface is formed at the border between the two layers. Moreover, the binder resin used in the charge generation layer is frequently different from the binder resin used in the charge transport layer, and the two layers are clearly distinguishable.

In contrast, the single-layer-type photosensitive layer of this exemplary embodiment has a vague border between the surface-side region where the charge generation material and the fluorine-containing electron transport material are present and the conductive-base-side region where the charge generation material is absent even when b is 0 and d is 0. Accordingly, the single-layer-type photosensitive layer of the exemplary embodiment is clearly different from typical multilayer-type photosensitive layers.

The single-layer-type photosensitive layer may be implemented in any form as long as the formula $30 \leq a/b$ representing the distribution of the charge generation material in the thickness direction of the photosensitive layer and the formula $30 \leq c/d$ representing the distribution of the fluorine-containing electron transport material in the thickness direction of the photosensitive layer are satisfied. For example, the following modifications are conceivable:

When b is 0 and d is 0, the charge generation material and the fluorine-containing electron transport material are present only in a region extending ¼ of the thickness from the surface-side of the photosensitive layer and are absent in a region extending ¾ of the thickness from the conductive-base-side of the photosensitive layer, or the charge generation material and the fluorine-containing electron transport material are present only in a region extending ⅓ of the thickness from the surface-side of the photosensitive layer and are absent in a region extending ⅔ of the thickness from the conductive-base-side of the photosensitive layer.

When b is more than 0 and d is more than 0 (in other words, when the charge generation material and the fluorine-containing electron transport material are present in all parts of the photosensitive layer), the charge generation material and the fluorine-containing electron transport material are abundant in a region extending ½ of the thickness of the photosensitive layer from the surface side of the photosensitive layer and may be less abundant in a region extending ½ of the thickness of the photosensitive layer from the conductive-base-side of the photosensitive layer than the region extending ½ of the thickness from the surface side, or the charge generation material and the fluorine-containing electron transport material are abundant in a region extending ⅓ of the thickness of the photosensitive layer from the surface side of the photosensitive layer and are less abundant in a region extending ⅔ of the thickness of the photosensitive layer from the conductive-base-side of the photosensitive layer than the region extending ⅓ of the thickness from the surface side, or the charge generation material and the fluorine-containing electron transport material are abundant in the region extending ⅓ of the thickness from the surface side of the photosensitive layer but the amount of the charge generation material is gradually decreased toward the conductive-base-side in the thickness direction of the photosensitive layer.

Among these modifications, those with b representing 0 and d representing 0 are preferable from the viewpoint of the low residual potential property.

When the formula 30≤e/f representing the distribution of the fluorine-containing electron transport material in the thickness direction of the photosensitive layer is satisfied, the modifications thereof may be the same as those that satisfy the formulae 30≤a/b and 30≤c/d described above. In other words, when f is 0, one modification would be that the fluororesin particles are present only in the region of the photosensitive layer where the charge generation material and the fluorine-containing electron transport material are present.

In contrast, when f is more than 0, for example, the fluororesin particles may be abundantly present in the region of the photosensitive layer where the charge generation material and the fluorine-containing electron transport material are also abundantly present. Among these modifications, the modifications with f representing 0 are preferable from the viewpoint of the low residual potential property. When the distribution of the fluororesin particles satisfies the above-described range, wear resistance of the photosensitive layer is also improved.

Method for Calculating a/b

The value a/b representing the distribution of the charge generation material in the thickness direction of the photosensitive layer is calculated by measuring the intensity of the peak of the charge generation material (in this exemplary embodiment, the peak near a wavenumber of 890 $cm^{-1}$) from a spectrum taken by total-reflection infrared spectroscopy and calculating a/b using the result.

Specifically, the photosensitive layer is removed from the photosensitive member to be measured and subjected to an embedding treatment, and the embedded layer is cut with a microtome in an oblique direction with respect to the interface between the conductive base and the photosensitive layer (in an oblique direction with respect to the perpendicular direction toward the photosensitive layer surface from the outer peripheral surface of the conductive base) so that the section taken in the thickness direction of the photosensitive layer serves as the measurement surface so as to obtain a measurement sample with an enlarged measurement surface. The measurement sample is analyzed with a total-reflection infrared spectroscope (FT-IR Spotlight 300 produced by Perkin Elmer Inc.; inner reflection element (prism): germanium (Ge), incident angle: 45°) so as to determine an integral intensity a of the infrared spectroscopic peak near a wavenumber of 890 $cm^{-1}$ in the region extending ⅓ of the thickness of the photosensitive layer from the surface-side of the photosensitive layer and an integral intensity b of the infrared spectroscopic peak near a wavenumber of 890 $cm^{-1}$ in the region extending ⅔ of the thickness of the photosensitive layer from the conductive-base-side of the photosensitive layer, from which the a/b ratio is calculated. The analysis is conducted on three positions of the measurement sample in determining a and b (a and b are each calculated as an average of the results taken at the three positions).

Method for Calculating c/d

The value c/d representing the distribution of the fluorine-containing electron transport material in the thickness direction of the photosensitive layer is calculated by measuring the intensity of the peak of the fluorine-containing electron transport material (in this exemplary embodiment, the peak near a wavenumber of 1720 $cm^{-1}$) from a spectrum taken by total-reflection infrared spectroscopy and calculating c/d using the result.

The specific procedure is the same as the above-described method for calculating a/b except that an integral intensity c of the infrared spectroscopic peak near a wavenumber of 1720 $cm^{-1}$ in the region extending ⅓ of the thickness of the photosensitive layer from the surface-side of the photosensitive layer and an integral intensity d of the infrared spectroscopic peak near a wavenumber of 1720 $cm^{-1}$ in the region extending ⅔ of the thickness of the photosensitive layer from the conductive-base-side of the photosensitive layer are calculated, and c/d is determined from the results. As in the method for calculating a/b, the analysis is conducted on three positions of the measurement sample in determining c and d (c and d are each calculated as an average of the results taken at the three positions).

Method for Calculating e/f

The value e/f representing the distribution of the fluororesin particles in the thickness direction of the photosensitive layer is determined by image-processing an image obtained with a scanning electron microscope (SEM) to determine e and f and calculating e/f from the measurement results.

Specifically, the photosensitive layer is removed from the photosensitive member to be measured, a small specimen is cut out from the photosensitive layer and embedded and fixed in an epoxy resin, and a section is prepared with a microtome so as to prepare a measurement sample for determining e and f. Three positions of the measurement sample are observed with a SEM JSM-6700F/JED-2300F (produced by JEOL Ltd.) so as to determine e and f (e and f are each calculated as an average of the results taken at the three positions).

The observation range of the SEM image is selected such that the length of the photosensitive layer in a direction parallel to the outer peripheral surface of the conductive base is 40 μm.

The thickness of the single-layer-type photosensitive layer is preferably set in the range of 5 μm or more and 60 μm or less and more preferably set in the range of 10 μm or more and 50 μm or less.

Binder Resin

The binder resin may be any binder resin. Examples thereof include polycarbonate resins, polyester resins, polyarylate resins, methacrylic resins, acrylic resins, polyvinyl chloride resin, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicon-alkyd resins, phenol-formaldehyde resins, styrene-alkyd resins, poly-N-vinylcarbazole, and polysilane. These binder resins may be used alone or in combination of two or more.

Among these binder resins, polycarbonate resins having a viscosity-average molecular weight of 30,000 or more and 80,000 or less may be used from the viewpoint of the photosensitive layer forming property of the photosensitive layer, for example.

The binder resin content relative to the total solid content in the photosensitive layer is 35% by weight or more and 60% by weight or less, or may be 20% by weight or more and 35% by weight or less.

Charge Generation Material

The charge generation material may be any charge generation material. Examples thereof include hydroxygallium phthalocyanine pigments, chlorogallium phthalocyanine pigments, titanyl phthalocyanine pigments, and metal-free phthalocyanine pigments. These charge generation materials may be used alone or in combination of two or more. Among these, hydroxygallium phthalocyanine pigments may be used from the viewpoint of increasing the sensitivity of the photosensitive member. A type V hydroxygallium phthalocyanine pigment is more preferable.

Hydroxygallium phthalocyanine pigments having a maximum peak wavelength in a range of 810 nm to 839 nm in an absorption spectrum in the wavelength range of 600 nm to 900 nm, for example, may be used since these pigments have superior dispersibility. Shifting the maximum peak wavelength of the absorption spectrum toward the short wavelength side relative to the typical V type hydroxygallium phthalocyanine pigments offers a fine hydroxygallium phthalocyanine pigment having appropriately controlled crystal orientation in the pigment particles. When such a pigment is used as the material of the electrophotographic photosensitive member, excellent dispersibility, sufficient sensitivity, chargeability, and dark attenuation characteristics are easily obtained.

A hydroxygallium phthalocyanine pigment having a maximum peak wavelength in the range of 810 nm to 839 nm may have an average particle size in a particular range and a BET specific surface area in a particular range. Specifically, the average particle size is preferably 0.20 μm or less, and more preferably 0.01 μm or more and 0.15 μm or less. The BET specific surface area is preferably 45 $m^2/g$ or more, more preferably 50 $m^2/g$ or more, and particularly preferably 55 $m^2/g$ or more and 120 $m^2/g$ or less. The average particle size is a volume-average particle size (d50 average particle size) measured with a laser diffraction-scattering particle size distribution meter (LA-700 produced by Horiba Ltd.). The BET specific surface area is measured with a BET specific surface area meter (FlowSorb II 2300 produced by Shimadzu Corporation) by a nitrogen substitution method.

When the average particle size is greater than 0.20 μm or the specific surface area i less than 45 $m^2/g$, the pigment particles are coarse or have a tendency to form aggregates. Moreover, the properties such as dispersibility, sensitivity, chargeability, and dark attenuation characteristics tend to be degraded, and image defects are likely to occur.

The maximum particle size (maximum primary particle size) of the hydroxygallium phthalocyanine pigment is preferably 1.2 μm or less, more preferably 1.0 μm or less, and most preferably 0.3 μm or less. When the maximum particle size exceeds the above-described range, black spots are likely to occur.

The hydroxygallium phthalocyanine pigment may have an average particle size of 0.2 μm or less, a maximum particle size of 1.2 μm or less, and a specific surface area of 45 $m^2/g$ or more from the viewpoint of suppressing unevenness in concentration caused by exposure of the photosensitive member to a fluorescent lamp or the like.

The hydroxygallium phthalocyanine pigment may be of a type V having diffraction peaks at Bragg angles (2θ±0.2°) of 7.5°, 9.9°, 12.5°, 16.3°, 18.6°, 25.1°, and 28.3° in an X-ray diffraction spectrum taken using a CuKα characteristic X-ray.

The chlorogallium phthalocyanine pigment may be any chlorogallium phthalocyanine pigment but may have diffraction peaks at Bragg angles (2θ±0.2°) of 7.4°, 16.6°, 25.5°, and 28.3° since the electrophotographic photosensitive member material exhibits excellent sensitivity.

The recommendable maximum peak wavelength of the absorption spectrum, average particle size, maximum particle size, and specific surface area of a chlorogallium phthalocyanine pigment are the same as those of the hydroxygallium phthalocyanine pigment.

The amount of the charge generation material in the photosensitive layer is 0.5% by weight or more and less than 2.0% by weight relative to the entire photosensitive layer. When the amount of the charge generation material is in this range, a photosensitive member having high chargeability and high sensitivity is obtained. The amount of the charge generation material in the photosensitive layer is preferably 0.7% by weight or more and 1.7% by weight or less and more preferably 0.9% by weight or more and 1.5% by weight or less relative to the entire photosensitive layer.

The amount of the charge generation material relative to the binder resin is, for example, preferably 0.05% by weight or more and 30% by weight or less, more preferably 1% by weight or more and 15% by weight or less, and yet more preferably 2% by weight or more and 10% by weight or less.

Hole Transport Material

The hole transport material may be any hole transport material. Examples thereof include oxadiazole derivatives such as 2,5-bis(p-diethylaminophenyl)-1,3,4-oxadiazole; pyrazoline derivatives such as 1,3,5-triphenyl-pyrazoline and 1-[pyridyl-(2)]-3-(p-diethylaminostyryl)-5-(p-diethylaminostyryl)pyrazoline; aromatic tertiary amino compounds such as triphenylamine, N,N'-bis(3,4-dimethylphenyl)biphenyl-4-amine, tri(p-methylphenyl)aminyl-4-amine, and dibenzylaniline; aromatic tertiary diamino compounds such as N,N'-bis(3-methylphenyl)-N,N'-diphenylbenzidine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone; quinazoline derivatives such as 2-phenyl-4-styryl-quinazoline; benzofuran derivatives such as 6-hydroxy-2,3-di(p-methoxyphenyl)benzofuran; α-stilbene derivatives such as p-(2,2-diphenylvinyl)-N,N-diphenylaniline; enamine derivatives, carbazole derivatives such as N-ethylcarbazole; poly-N-vinylcarbazole and its derivatives; and a polymer having a group containing any one of the above-described compounds in a main chain or a side chain. These hole transport materials may be used alone or in combination.

Among these, triarylamine derivatives represented by structural formula (a-1) below and benzidine derivatives represented by structural formula (a-2) below may be used from the viewpoint of charge mobility:

(a-1)

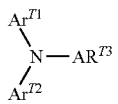

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent for each group include a halogen atom, an alkyl group having 1 to 5 carbon atoms, an alkoxy group having 1 to 5 carbon atoms, and a substituted amino group substituted with an alkyl group having 1 to 3 carbon atoms.

(a-2)

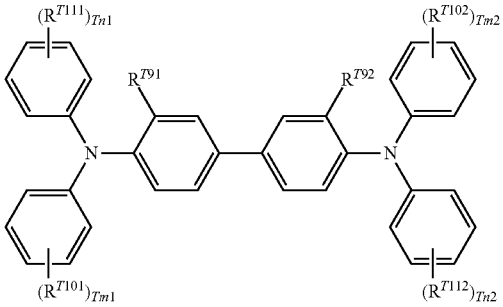

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer or 0 or more and 2 or less.

Examples of the substituent for each group include a halogen atom, an alkyl group having 1 to 5 carbon atoms, an alkoxy group having 1 to 5 carbon atoms, and a substituted amino group substituted with an alkyl group having 1 to 3 carbon atoms.

Among the triarylamine derivatives represented by structural formula (a-1) and the benzidine derivatives represented by structural formula (a-2), triarylamine derivatives that have "$—C_6H_4—CH=CH—CH=C(R^{T7})(R^{T8})$" and benzidine derivatives having "$—CH=CH—CH=C(R^{T15})(R^{T16})$" may be used from the viewpoint of charge mobility.

Specific examples of the compounds represented by structural formula (a-1) and the compounds represented by structural formula (a-2) include the following compounds:

HT-1

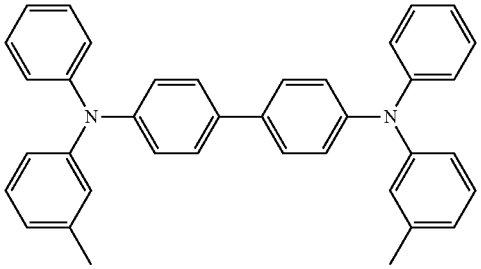

HT-2

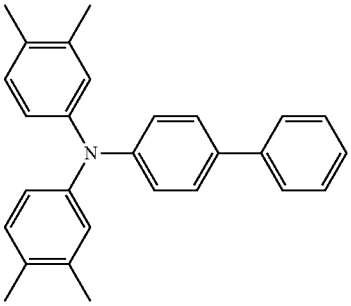

HT-3

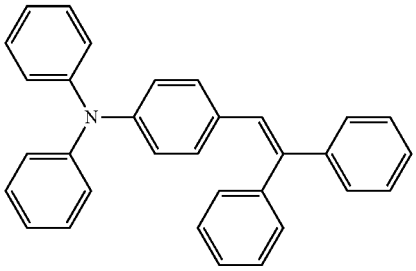

HT-4

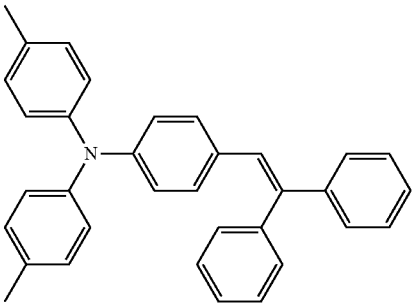

-continued

HT-5

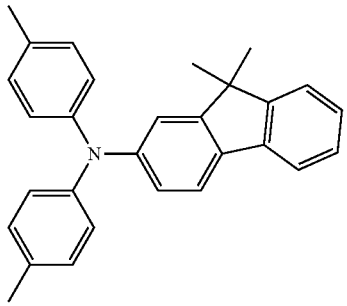

HT-6

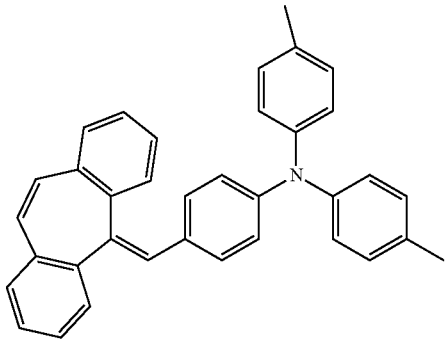

HT-7

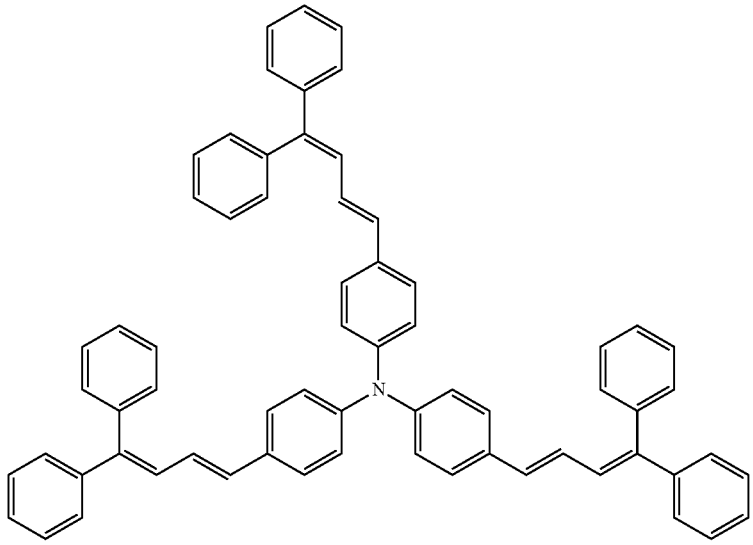

HT-8

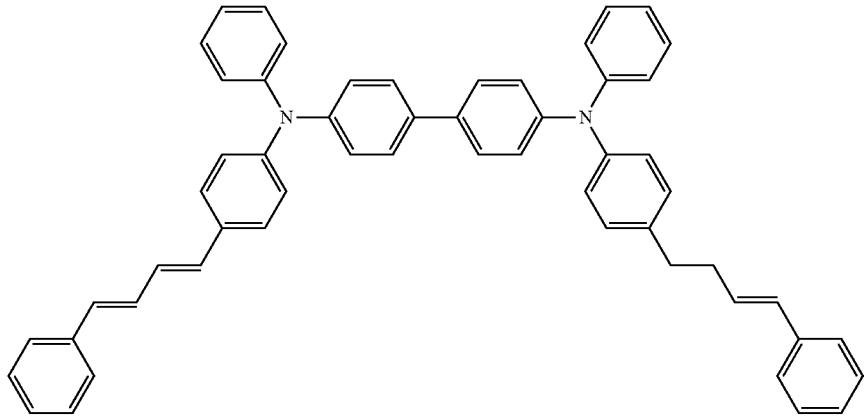

The amount of the hole transport material relative to the binder resin is, for example, 10% by weight or more and 98% by weight or less, preferably 60% by weight or more and 95% by weight or less, and more preferably 70% by weight or more and 90% by weight or less.

Fluorine-atom-containing Electron Transport Material

The fluorine-atom-containing electron transport material (fluorine-containing electron transport material) is not particularly limited. Examples thereof include quinone compounds such as tetrafluoro-1,4-benzoquinone; tetracyanoquinodimethane compounds such as 2,3,5,6-tetrafluoro-7,7,8,8-tetracyanoquinodimethane; fluorenone compounds such as 2-fluoro-9-fluorenone, 2,7-di(trifluoromethyl)-9-fluorenone, and 9-dicyanomethylene-9-fluorenone-4-carboxylic acid perfluorooctyl; oxadiazole compounds such as 2,5-bis(trifluoromethyl)-1,3,4-oxadiazole, 2,5-bis(pentafluorophenyl)-1,3,4-oxadiazole, 2,5-di(4-trifluoromethylphenyl)-1,3,4-oxadiazole, 2-(4-biphenyl)-5-(4-trifluoromethylphenyl)-1,3,4-oxadiazole, and 2,5-di(6-trifluoromethylnaphthyl)-1,3,4-oxadiazole; xanthone compounds such as 1-fluoroxanthone and 2-(trifluoromethyl)xanthone; thiophene compounds such as 2,3,5-trifluorothiophene; dinaphthoquinone compounds such as 3,3'-ditrifluoromethyl-dinaphthoquinone; and diphenoquinone compounds such as 3,3',5,5'-tetrafluorodiphenoquinone and 3,3',5,5'-tetra(trifluoromethyl)-4,4'-diphenoquinone. Other examples include compounds having benzoquinone skeletons, compounds having fluorenone skeletons, compounds having oxadiazole skeletons, compounds having xanthone skeletons, compounds having thiophene skeletons, compounds having dinaphthoquinone skeletons, and a material obtained by partly or entirely substituting a polymer having a group including a compound having, in a main chain or side chain, a diphenoquinone skeleton. These fluorine-containing electron transport materials may be used alone or in combination.

Among these, fluorenone compounds having fluorine atoms are preferable, fluorenone compounds having substituents including fluoroalkyl groups are more preferable, fluorenone compounds having fluoroalkyl ester groups are yet more preferable, and fluorenone compounds represented by structural formula (b-1) below are particularly preferable from the viewpoint of a low residual potential property.

(b-1)

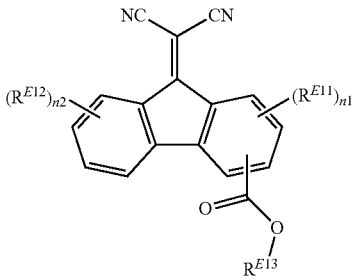

In structural formula (b-1), $R^{E11}$ and $R^{E12}$ each independently represent a halogen atom, an alkyl group, an alkoxy group, an aryl group, or an aralkyl group. $R^{E13}$ represents a fluoroalkyl group, and n1 and n2 each independently represent an integer of 0 or more and 4 or less.

Examples of the halogen atom represented by $R^{E11}$ and $R^{E12}$ in structural formula (b-1) include a fluorine atom, a chlorine atom, a bromine atom, and an iodine atom.

Examples of the alkyl group represented by $R^{E11}$ and $R^{E12}$ in structural formula (b-1) include straight-chain or branched alkyl group having 1 to 4 carbon atoms (preferably 1 to 3 carbon atoms). Specific examples thereof include a methyl group, an ethyl group, an n-propyl group, an isopropyl group, an n-butyl group, an isobutyl group, and a tert-butyl group.

Examples of the alkoxy group represented by $R^{E11}$ and $R^{E12}$ in structural formula (b-1) include alkoxy groups having 1 to 4 carbon atoms (preferably 1 to 3 carbon atoms) such as a methoxy group, an ethoxy group, a propoxy group, and a butoxy group.

Examples of the aryl group represented by $R^{E11}$ and $R^{E12}$ in structural formula (b-1) include a phenyl group and a tolyl group.

Examples of the aralkyl group represented by $R^{E11}$ and $R^{E12}$ in structural formula (b-1) include a benzyl group, a phenethyl group, and a phenylpropyl group. Of these, a phenyl group is preferable.

In structural formula (b-1), each of the substituents represented by $R^{E11}$ and $R^{E12}$ may further include a substituent. Examples of this substituent include atoms and groups given as examples above (for example, a halogen atom, an alkyl group, an alkoxy group, and an aryl group).

In structural formula (b-1), the fluoroalkyl group represented by $R^{E13}$ is a group represented by $-L^{E14}-R^{E15}$ where $L^{E14}$ represents a single bond or an alkylene group and $R^{E15}$ represents a perfluoroalkyl group. When $L^{E14}$ represents a single bond, the oxygen atom (O) in —C(═O)O— is directly bonded to $—R^{E15}$ in structural formula (b-1).

Examples of the alkylene group represented by $L^{E14}$ include straight-chain or branched alkylene groups having 1 to 3 carbon atoms (preferably 1 or 2 carbon atoms). Examples of the straight-chain or branched alkylene group having 1 to 3 carbon atoms represented by $L^{E14}$ include a methylene group, an ethylene group, an n-propylene group, and an isopropylene group.

Examples of the perfluoroalkyl group represented by $R^{E15}$ include straight-chain or branched perfluoroalkyl groups having 2 to 10 carbon atoms (the number of carbon atoms is preferably an integer in the range of 3 to 10 and more preferably an integer in the range of 5 to 8).

Examples of the straight-chain perfluoroalkyl group represented by $R^{E15}$ include a pentafluoroethyl group, an n-heptafluoropropyl group, an n-nonafluorobutyl group, an n-undecafluoropentyl group, an n-tridecafluorohexyl group, an n-pentadecafluoroheptyl group, an n-heptadecafluorooctyl group, an n-nonadecafluorononyl group, and an n-heneicosafluorodecyl group.

Examples of the branched perfluoroalkyl group represented by $R^{E15}$ include a heptafluoroisopropyl group, a nonafluoroisobutyl group, a nonafluoro-sec-butyl group, a nonafluoro-tert-butyl group, an undecafluoroisopentyl group, an undecafluoroneopentyl group, an undecafluoro-tert-pentyl group, a tridecafluoroisohexyl group, a tridecafluoro-sec-hexyl group, a tridecafluoro-tert-hexyl group, a pentadecafluoroisoheptyl group, a pentadecafluoro-sec-heptyl group, a pentadecafluoro-tert-heptyl group, a heptadecafluoroisooctyl group, a heptadecafluoro-sec-octyl group, a heptadecafluoro-tert-octyl group, a nanodecafluoroisononyl group, a nanodecafluoro-sec-nonyl group, a nonadecafluoro-tert-nonyl group, a heneicosafluoroisodecyl group, a heneicosafluoro-sec-decyl group, and a heneicosafluoro-tert-decyl group.

From the viewpoint of the low residual potential property, the electron transport material represented by structural formula (b-1) may be a material in which the fluoroalkyl group represented by $R^{E13}$ is a straight-chain perfluoroalkyl group having 5 to 8 carbon atoms, n1 and n2 each independently represent 0, and $—C(═O)O—R^{E13}$ substitutes the 2-position or 4-position. In particular, a compound referred to as Example Compound "b-1-1" (9-dicyanomethylene-9-fluorenone-4-carboxylic acid perfluorooctyl) is particularly preferable.

Example Compounds of the electron transport material represented by structural formula (b-1) are described below but these examples are not limiting. Example Compounds listed below are hereinafter each referred to as "Example Compound (b-1-Number)". An example thereof is "Example Compound (b-1-1)".

| Example Compound | n1 | n2 | $R^{E11}$ | $R^{E12}$ | —CO(═O)—$R^{E13}$ | $R^{E13}$ |
|---|---|---|---|---|---|---|
| b-1-1 | 0 | 0 | — | | 4-C(═O)O—$R^{E13}$ | -n-$C_8F_{17}$ |
| b-1-2 | 0 | 0 | — | | 4-C(═O)O—$R^{E13}$ | -n-$C_6F_{13}$ |
| b-1-3 | 0 | 0 | — | | 4-C(═O)O—$R^{E13}$ | -n-$C_4F_9$ |
| b-1-4 | 0 | 0 | — | | 4-C(═O)O—$R^{E13}$ | —$CH_2$-n-$C_8F_{17}$ |
| b-1-5 | 0 | 0 | — | | 4-C(═O)O—$R^{E13}$ | —$CH_2$-n-$C_6F_{13}$ |
| b-1-6 | 0 | 0 | — | | 4-C(═O)O—$R^{E13}$ | —$CH_2$-n-$C_4F_9$ |
| b-1-7 | 0 | 0 | — | | 2-C(═O)O—$R^{E13}$ | -n-$C_8F_{17}$ |
| b-1-8 | 0 | 0 | — | | 2-C(═O)O—$R^{E13}$ | —$CH_2$-n-$C_8F_{17}$ |
| b-1-9 | 3 | 4 | 1~3-$CF_3$ | 5~8-$CF_3$ | 4-C(═O)O—$R^{E13}$ | -n-$C_8F_{17}$ |

The abbreviations used in Example Compounds listed above are as follows:

"Number-" indicates a substituent that substitutes the site of the fluorenone ring of that number. For example, 4-C(═O)O—$R^{E13}$ indicates —C(═O)O—$R^{E13}$ that substitutes the 4-position of the fluorenone ring and 2-C(═O)O—$R^{E13}$ indicates —C(═O)O—$R^{E13}$ that substitutes the 2-position of the fluorenone ring.

"1~3-" indicates that there are substituents in all of 1-position, 2-position, and 3-position, "5~8-" indicates that there are substituents in all of 5-position to 8-position. For example, "1~3-$CF_3$" indicates that every one of 1-position to 3-position is substituted with a $CF_3$ group (trifluoromethyl group).

The amount of the fluorine-containing electron transport material relative to the binder resin is, for example, 4% by weight or more and 70% by weight or less, more preferably 8% by weight or more and 50% by weight or less, and yet more preferably 10% by weight or more and 30% by weight or less.

Weight Ratio of Hole Transport Material to Fluorine-containing Electron Transport Material The ratio of the hole transport material to the fluorine-containing electron transport material on a weight basis, i.e., the hole transport material/electron transport material weight ratio, is preferably 50/50 or more and 90/10 or less, and more preferably 60/40 or more and 80/20 or less.

Fluorine-containing Resin Particles

The fluorine-containing resin particles (fluororesin particles) are not particularly limited. Examples thereof include particles composed of polytetrafluoroethylene (PTFE) resin, polychlorotrifluoroethylene resin, polyhexafluoropropylene resin, polyvinyl fluoride resin, polyvinylidene fluoride resin, polydichlorodifluoroethylene resin, and copolymers thereof (e.g., tetrafluoroethylene/hexafluoropropylene/perfluoroalkyl vinyl ether copolymer (FEP) and tetrafluoroethylene/perfluoroalkyl vinyl ether copolymer (PFA)). One or a combination of two or more types of the fluororesin particles may be used. Among these, polytetrafluoroethylene resin and polyvinylidene fluoride resin are preferred and polytetrafluoroethylene resin is more preferred from the viewpoint of the affinity with the fluorine-containing electron transport material.

The fluororesin particles preferably have an average primary particle size of 0.05 μm or more and 1 μm or less and more preferably 0.1 μm or more and 0.5 μm or less.

The primary particle size is determined by preparing a sample specimen from a single-layer-type photosensitive layer, observing the sample specimen with a scanning electron microscope (SEM) at a magnification of, for example, 5000 or higher, measuring the maximum diameter of each fluororesin particle in a primary particle state, and calculating the average of 50 particles. A SEM JSM-6700F produced by JEOL Ltd., is used as the SEM, and a secondary electron image at an acceleration voltage of 5 kV is observed.

Examples of the commercially available fluororesin particles include Lubron (registered trademark) series (produced by Daikin Industries, Ltd.), Teflon (registered trademark) series (produced by Du Pont), and Dyneon (registered trademark) series (produced by Sumitomo 3M Ltd.).

The amount of the fluororesin particles relative to the total solid content of the photosensitive layer is preferably 1% by weight or more and 30% by weight or less, more preferably 3% by weight or more and 20% by weight or less, and yet more preferably 5% by weight or more and 15% by weight or less from the viewpoint of the low residual potential property.

Other Additives

Fluorine-containing Dispersing Agent

The single-layer-type photosensitive layer may contain a fluorine-containing dispersing agent from the viewpoint of dispersibility of the fluororesin particles.

Examples of the fluorine-containing dispersing agent are the following resins obtained polymerizing reactive monomers (hereinafter these resins are referred to as "specified resins"): a random or block copolymer of an acrylate having a perfluoroalkyl group and a monomer free of fluorine; a random or block copolymer of a methacrylate homopolymer, the acrylate having a perfluoroalkyl group, and the monomer free of fluorine; and a random or block copolymer of a methacrylate and the monomer free of fluorine. Examples of the acrylate having a perfluoroalkyl group include 2,2,2-trifluoroethyl methacrylate and 2,2,3,3,3-pentafluoropropyl methacrylate.

Examples of the monomer free of fluorine include isobutyl acrylate, t-butyl acrylate, isooctyl acrylate, lauryl acrylate, stearyl acrylate, isobornyl acrylate, cyclohexyl acrylate, 2-methoxyethyl acrylate, methoxy triethylene glycol acrylate, 2-ethoxyethyl acrylate, tetrahydrofurfuryl acrylate, benzyl acrylate, ethylcarbitol acrylate, phenoxyethyl acrylate, 2-hydroxy acrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl o-phenylphenol acrylate, o-phenylphenol glycidyl ether acrylate, block or branched polymers disclosed in U.S. Pat. No. 5,637,142 and Japanese Patent No. 4251662. Examples of the fluorine-containing dispersing agent include fluorine surfactants such as Surflon (registered trademark) S-611 and Surflon (registered trademark) S-385 produced by AGC SEIMI CHEMICAL CO., LTD., Ftergent 730FL and Ftergent 750FL produced by NEOS Company Limited, PF-636 and PF-6520 produced by Kitamura Chemicals Co., Ltd., Megaface (registered trademark) EXP. TF-1507 and Megaface (registered trademark) EXP. TF-1535 produced by DIC Corporation, and FC-4430 and FC-4432 produced by 3M.

The weight-average molecular weight of the specified resin may be 100 or more and 50,000 or less.

The weight-average molecular weight of the fluorine-containing dispersing agent is a value measured by gel permeation chromatography (GPC). GPC molecular weight measurement is conducted by using, for example, GPC-HLC-8120 produced by Tosoh Corporation as a measurement instrument with TSKgel GMHHR-M+TSKgel GMHHR-M (7.8 mm I.D.×30 cm) produced by Tosoh Corporation as columns and a chloroform solvent. The weight-average molecular weight is calculated from the measurement results by using molecular weight calibration curves prepared from monodisperse polystyrene standard samples.

The amount of the fluorine-containing dispersing agent relative to the total solid content of the photosensitive layer is preferably 0.1% by weight or more and 1% by weight or less, and more preferably 0.2% by weight or more and 0.5% by weight or less. One fluorine-containing dispersing agent may be used or a combination of two or more fluorine-containing dispersing agents may be used.

Additives other than Fluorine-containing Dispersing Agent

The single-layer-type photosensitive layer may further contain other known additives such as an antioxidant, a photostabilizer, and a thermal stabilizer. When the single-layer-type photosensitive layer constitutes a surface layer, the single-layer-type photosensitive layer may contain silicone oil or the like.

Formation of single-layer-type Photosensitive Layer

A method for forming a single-layer-type photosensitive layer according to an exemplary embodiment will now be described. In the description below, a method with which a charge generation material, a fluorine-containing electron transport material, and fluororesin particles are caused to localize in the surface-side region of the photosensitive layer is used as an example.

The method for forming the single-layer-type photosensitive layer is not particularly limited. A single-layer-type photosensitive layer may be formed on a conductive base, or if an undercoat layer is provided, may be formed on the undercoat layer on the conductive base, for example. An example of such a method includes a step of preparing a coating solution for forming a photosensitive layer, the coating solution containing a binder resin, a charge generation material, a hole transport material, a fluorine-containing electron transport material, and fluororesin particles, a step of forming a coating film by applying the coating solution for forming a photosensitive layer onto a conductive base, and a step of forming a single layer-type photosensitive layer by heating and drying the coating film.

The step of preparing a coating solution for forming a photosensitive layer includes the following steps: a step of preparing a first coating solution for forming a photosensitive layer, the first coating solution containing a binder resin, a charge generation material, a hole transport material, a fluorine-containing electron transport material, and fluororesin particles; and a step of preparing a second coating solution for forming a photosensitive layer, the second coating solution containing a binder resin and a hole transport material, and less charge generation material, less fluorine-containing electron transport material, and less fluororesin particles than the first coating solution ("less" includes the instances where the amount of each material is zero).

The step of forming a coating film includes a step of forming a second coating film and a first coating film by applying the second coating solution for forming a photosensitive layer and the first coating solution for forming a photosensitive layer on the conductive base. Specifically, the step of preparing a coating solution for forming a photosensitive layer includes a second coating film forming step of forming a second coating film by applying the second coating solution for forming a photosensitive layer onto a conductive base, and a first coating film forming step of forming a first coating film by applying the first coating solution for forming a photosensitive layer onto the second coating film.

A specific method for forming a single-layer-type photosensitive layer will now be described.

Step of Preparing Coating Solutions for Forming Photosensitive Layer

First, coating solutions for forming a photosensitive layer are prepared. For example, a first coating solution for forming a photosensitive layer is prepared by adding a binder resin, a charge generation material, a hole transport material, a fluorine-containing electron transport material, fluororesin particles, etc., to a solvent. A second coating solution for forming a photosensitive layer containing a binder resin and a hole transport material, and less charge generation material, less fluorine-containing electron transport material, and less fluororesin particles than the first coating solution for forming a photosensitive layer is prepared. In the case where a region free of the charge generation material, the fluorine-containing electron transport material, and the fluororesin particles is to be formed on the conductive-base-side of the photosensitive layer, a coating solution that does not contain a charge generation material, a fluorine-containing electron transport material, or fluororesin particles is prepared as the second coating solution for forming a photosensitive layer. In the case where the charge generation material content, the fluorine-containing electron transport material content, and the fluororesin particle content are to be gradually decreased to form a gradient in the thickness direction of the photosensitive layer, a third coating solution for forming a photosensitive layer having a charge generation material content, a fluorine-containing electron transport material content, and a fluororesin particle content smaller than those of the first coating solution but larger than those of the second coating solution may be prepared.

In the case where the second coating solution for forming a photosensitive layer is not to contain a charge generation material, a fluorine-containing electron transport material, or fluororesin particles, a second coating solution for forming a photosensitive layer containing a binder resin and a hole transport material (that is, a coating solution that does not contain a charge generation material, a fluorine-containing electron transport material, and fluororesin particles) may be prepared. The second coating solution for forming a photosensitive layer may contain fluororesin particles. For example, a second coating solution for forming a photosensitive layer containing a binder resin, a hole transport material, and fluororesin particles (that is, a coating solution that does not contain a charge generation material or a fluorine-containing electron transport material) may be prepared.

Each of the coating solutions for forming a photosensitive layer is prepared by adding the above-described components to a solvent.

Examples of the solvent used in the coating solutions are organic solvents. Examples of the organic solvents include aromatic hydrocarbons such as benzene, toluene, xylene, and chlorobenzene; ketones such as acetone, 2-butanone, and methyl ethyl ketone; halogenated aliphatic hydrocarbons such as methylene chloride, chloroform, and ethylene chloride; cyclic or straight-chain ethers such as tetrahydrofuran and ethyl ether; and aliphatic hydrocarbons such as 2-methylpentane, cyclopentane, and cyclopentanone. These solvents may be used alone or as a mixture of two or more.

Examples of the equipment for dispersing and dissolving particles (for example, the charge generation material, the fluorine-containing electron transport material, and the fluororesin particles) in a coating solution for forming a photosensitive layer include media dispersers such as a ball mill, a vibrating ball mill, an attritor, a sand mill, and a horizontal mill and media-less disperses such as an agitator, an ultrasonic disperser, a roll mill, and a high-pressure homogenizer. The high-pressure homogenizer may be of a collision type in which a dispersion is dispersed under a high pressure through liquid-liquid collision or liquid-wall collision, or of a penetration type in which a material is caused to penetrate through narrow channels under a high pressure, for example.

Coating Film Forming Step

Next, a coating film is formed by applying a coating solution for forming a photosensitive layer onto a conductive base. For example, a second coating film is formed by applying a second coating solution for forming a photosensitive layer onto a conductive base and then a first coating film is formed by applying a first coating solution for forming a photosensitive layer onto the second coating film.

In the case where a third coating film is to be formed by using a third coating solution for forming a photosensitive layer, a third coating forming step of forming a third coating film by applying the third coating solution for forming a photosensitive layer onto the second coating film is performed before forming the first coating film. In this case, a coating film in which the charge generation material content, the fluorine-containing electron transport material content, and the fluororesin particle content gradually decrease from the first coating film toward the second coating film with respect to the thickness direction of the photosensitive layer can be formed.

The method for applying the second coating solution for forming a photosensitive layer and the method for applying the first coating solution for forming a photosensitive layer are not particularly limited. Examples of the methods include an inkjet coating method, a dip coating method, a blade coating method, a wire bar coating method, a spray coating method, a ring coating method, a bead coating method, an air knife coating method, and a curtain coating method. Considering the efficiency of forming the photosensitive layer, the method for applying the second coating solution for forming a photosensitive layer and the method for applying the first coating solution for forming a photosensitive layer are preferably the same.

However, for example, according to a film formation by a dip coating method, the first coating solution for forming a photosensitive layer may mix with all components of the second coating film when the first coating solution for forming a photosensitive layer is being applied onto the second coating film. As a result, it is sometimes difficult to form a photosensitive layer in which the charge generation material, the fluorine-containing electron transport material, and the fluororesin particles are localized on the surface side of the photosensitive layer.

In order to form a photosensitive layer in which the charge generation material is localized on the surface side of the photosensitive layer, a method may be employed with which the first coating solution for forming a photosensitive layer does not mix with all components of the second coating film. For example, an inkjet coating method, a spray coating method, or the like may be employed. An inkjet coating method may be employed in order to efficiently form a photosensitive layer.

According to these methods, a single-layer-type photosensitive layer is formed which has no clear interface at the border with the conductive-base-side region of the photosensitive layer in which the charge generation material, the fluorine-containing electron transport material, and the fluororesin particles are less abundant.

Next, an inkjet coating method which is an example of a coating method employed to form a single-layer-type photosensitive layer is described.

Figure 2A:
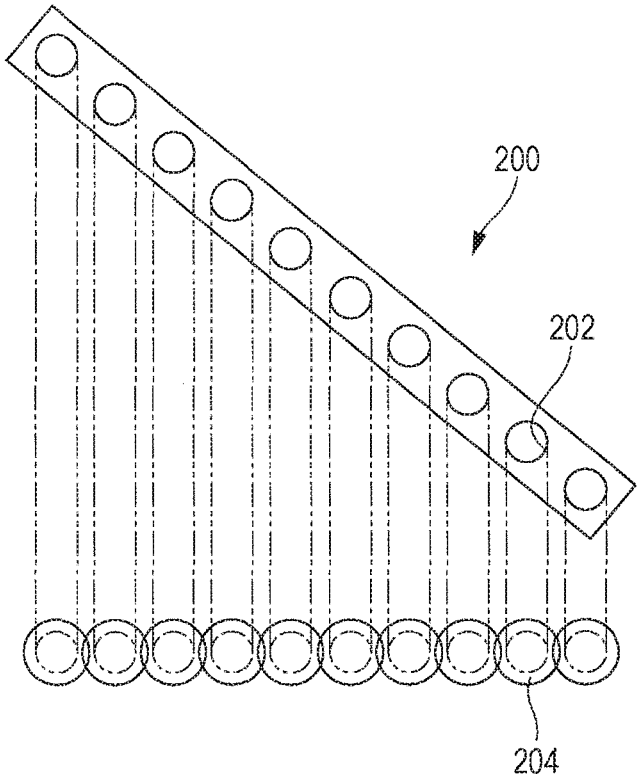
FIG. 2A is a schematic view illustrating overlap of droplets ejected from droplet discharge units by an inkjet coating method and FIG. 2B is a schematic view illustrating tilting of a droplet discharge unit with respect to a conductive base.
Figure 2B:
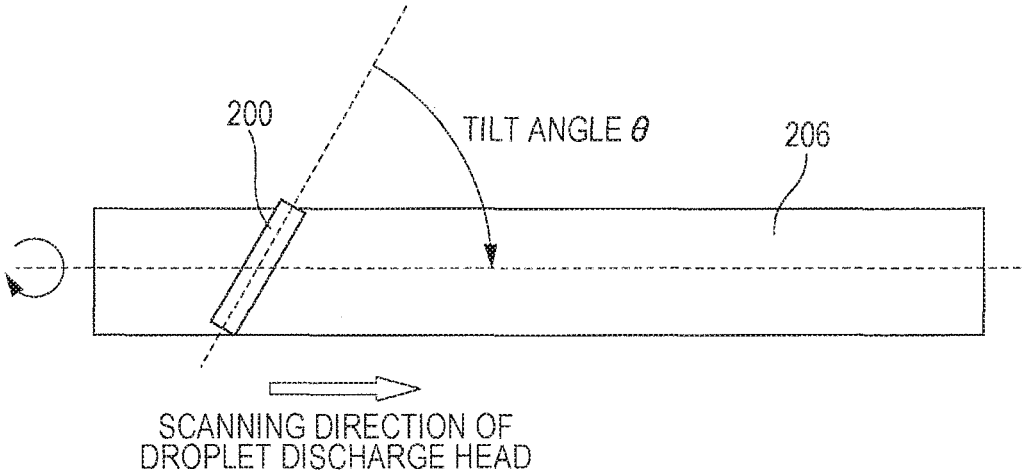
Figure 3:
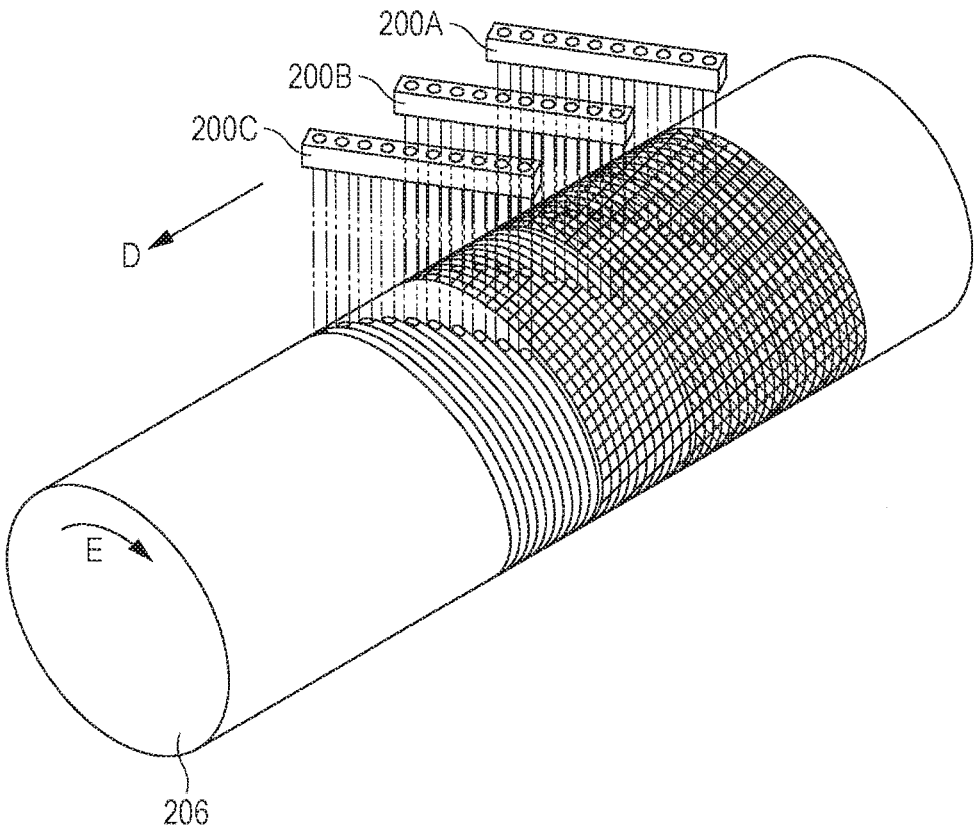
FIG. 3 is a schematic view illustrating an example of a method for forming a single-layer-type photosensitive layer by an inkjet coating method.

FIGS. 2A, 2B, and 3 are schematic diagrams illustrating a method for forming a coating film by an inkjet coating method. As illustrated in FIG. 2B, a liquid discharge unit 200 is tilted with respect to the axis of a conductive base 206. The coating solution for forming a photosensitive layer discharged from nozzles 202 of the liquid discharge unit 200 land on the surface of the conductive base 206, and adjacent droplets 204 come into contact with each other to coat the base. In other words, as illustrated in FIG. 2A, although the size of each droplet immediately after discharge is about the same as the nozzle diameter as indicated by dotted lines, the droplets that have landed on the surface of the conductive base 206 spread and come into contact with adjacent droplets as indicated by solid lines to form a coating film.

Specifically, as illustrated in FIG. 3, the conductive base 206 is loaded into a device that rotates the axis of the conductive base 206 in a direction indicated by arrow E. A first droplet discharge unit 200A, a second droplet discharge unit 200B, and a third droplet discharge unit 200C are arranged in such a manner that droplets of the coating solution for forming a photosensitive layer can be ejected onto the conductive base 206, and the solutions for forming a photosensitive layer are charged into the droplet discharge units 200A to 200C. Under these conditions, the conductive base 206 is rotated and the solutions for forming a photosensitive layer are ejected from nozzles 202 installed in the droplet discharge units 200A to 200C. The first droplet discharge unit 200A, the second droplet discharge unit 200B, and the third droplet discharge unit 200C are moved in the direction indicated by arrow D in FIG. 3 from one end of the conductive base 206 to the other end so as to form a coating film.

For example, a first coating solution for forming a photosensitive layer containing a charge generation material, a fluorine-containing electron transport material, fluororesin particles, etc., is charged into the first droplet discharge unit 200A, and a second coating solution for forming a photosensitive layer containing less (or no) charge generation material, fluorine-containing electron transport material, and fluororesin particles than the first coating solution for forming a photosensitive layer is charged into the second droplet discharge unit 200B (in this example, the third droplet discharge unit 200C is not used).

Alternatively, a first coating solution for forming a photosensitive layer containing a charge generation material, a fluorine-containing electron transport material, fluororesin particles, etc., is charged into the first droplet discharge unit 200A, and a second coating solution for forming a photosensitive layer containing less (or no) charge generation material, fluorine-containing electron transport material, and fluororesin particles than the first coating solution for forming a photosensitive layer is charged into the second droplet discharge unit 200B and the third droplet discharge unit 200C.

Then a coating film is formed by the method described above so as to form a single-layer-type photosensitive layer which has a conductive-base-side region where the charge generation material content, the fluorine-containing electron transport material content, and the fluororesin particle content are low and a surface-side region where the charge generation material content, the fluorine-containing electron transport material content, and the fluororesin particle content are high.

In the case where the aforementioned third coating solution for forming a photosensitive layer is used, the second coating solution for forming a photosensitive layer may be charged into the third droplet discharge unit 200C, the third coating solution for forming a photosensitive layer may be charged into the second droplet discharge unit 200B, and the first coating solution for forming a photosensitive layer containing a charge generation material, a fluorine-containing electron transport material, fluororesin particles, etc., may be charged into the first droplet discharge unit 200A. Then a coating film may be formed.

In the case where a protective layer is to be formed, a second coating solution for forming a photosensitive layer may be charged into the third droplet discharge unit 200C, the first coating solution for forming a photosensitive layer may be charged into the second droplet discharge unit 200B, and a coating solution for forming a protective layer may be charged into the first droplet discharge unit 200A. Then a photosensitive layer may be formed and then a protective layer may be formed.

In the description above, an example of charging the coating solutions for forming a photosensitive layer are charged into the droplet discharge units 200A to 200C is mainly described, but this example is not limiting. Moreover, in FIG. 3, an example in which three droplet discharge units 200A to 200C are formed is illustrated; however, this example is not limiting. The number of droplet discharge units may be any value that suits the thickness of the photosensitive layer, the amount of the droplets ejected, etc., as long as the charge generation material, the fluorine-containing electron transport material, and fluororesin particles are localized in the photosensitive layer.

An example of a method with which a charge generation material, a fluorine-containing electron transport material, and fluororesin particles are localized in the surface-side region of the photosensitive layer is described above; however, localization of fluororesin particles in the surface-side region of the photosensitive layer is optional as long as fluororesin particles are contained in the surface-side region of the photosensitive layer.

In other words, a photosensitive layer can be formed which has a surface-side region (region extending ⅓ of the thickness of the photosensitive layer from the surface side of the photosensitive layer) that contains a binder resin, a charge generation material, a hole transport material, a fluorine-containing electron transport material, and fluororesin particles, and a conductive-base-side region (region extending ⅔ of the thickness of the photosensitive layer from the conductive-base side of the photosensitive layer) that contains a binder resin and a hole transport material (in other words, no charge generation material or fluorine-containing electron transport material is contained but fluororesin particles may be contained).

The amount of a droplet of the coating solution for forming a photosensitive layer, ejected from a nozzle 202 of the liquid discharge unit 200 by an inkjet coating method described above may be any and may be, for example, 1 pl or more and 50 pl or less.

Examples of the droplet ejection method employed in the inkjet coating method include continuous methods and intermittent methods (a piezoelectric method that uses piezoelectric elements, a thermal method, or an electrostatic method), but the droplet ejection method is not particularly limited. The continuous ejection method and piezoelectric-type intermittent ejection method are preferable, and the continuous ejection method is more preferable from the viewpoints of productivity and discharge stability.

Photosensitive Layer Forming Step

The coating film formed in the coating film forming step is heated and dried by a hot air drying method or the like to form a single-layer-type photosensitive layer of the exemplary embodiment. The coating film drying conditions may be any conditions under which the coating film can be dried and cured. For example, the conditions are set according to the type of solvent used. Specifically, the drying temperature may be 100° C. or higher and 170° C. or lower, and the drying time may be 10 minutes or longer and 120 minutes or shorter.

Protective Layer

The protective layer is formed on the photosensitive layer if needed. The protective layer is formed to prevent chemical changes in the photosensitive layer during charging and further improve mechanical strength of the photosensitive layer. Thus, the protective layer may be a layer constituted by a cured film (crosslinked film). Examples of such a cured film include layers described in 1) and 2) below:

1) A layer constituted by a cured film of a composition that contains a reactive-group-containing charge transport material having a reactive group and a charge transport skeleton in the same molecule (in other words, a layer that contains a polymer or a crosslinked product of the reactive-group-containing charge transport material)
2) A layer constituted by a cured film of a composition that contains an unreactive charge transport material and an unreactive-group-containing non-charge transport material having a reactive group but not having a charge transport skeleton (in other words, a layer containing a polymer or a cross-linked product of the unreactive charge transport material and the reactive-group-containing non-charge transport material)

Examples of the reactive group of the reactive-group-containing charge transport material include a chain-polymerizable group, an epoxy group, —OH, —OR [where R represents an alkyl group], —$NH_2$, —SH, —COOH, —$SiR^{Q1}{}_{3-Qn}(OR^{Q2})_{Qn}$ [where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer in the range of 1 to 3], and other known reactive groups.

The chain-polymerizable group may be any radically polymerizable functional group. An example thereof is a functional group having a group that contains at least a carbon double bond. A specific example thereof is a group that contains at least one selected from the group consisting of a vinyl group, a vinyl ether group, a vinyl thioether group, a styryl group (vinylphenyl group), an acryloyl group, a methacryloyl group, and derivatives thereof. In particular, a group containing at least one selected from the group consisting of a vinyl group, a styryl group (vinylphenyl group), an acryloyl group, a methacryloyl group, and derivatives thereof is preferable since it has excellent reactivity.

The charge transport skeleton of the reactive-group-containing charge transport material may be any structure of the electrophotographic photosensitive member known in the art. Examples thereof include skeletons derived from nitrogen-containing hole transport compounds such as triarylamine compounds, benzidine compounds, and hydrazone compounds and conjugated with a nitrogen atom. Among these, a triarylamine skeleton is preferable.

The reactive-group-containing charge transport material having the reactive group and the charge transport skeleton, the unreactive charge transport material, and the reactive-group-containing non-charge transport material may be selected from materials known in the art.

The protective layer may further contain known additives.

The protective layer may be formed by any known method. For example, the protective layer may be formed by applying a coating solution for forming a protective layer prepared by adding the above-described components to a solvent so as to form a coating film, drying the coating film, and, if needed, heating the dried coating film to conduct curing.

Examples of the solvent used to prepare the coating solution for forming a protective layer include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol. These solvents may be used alone or as a mixture of two or more.

The coating solution for forming a protective layer may be a solvent-free coating solution.

Examples of the method employed in applying the coating solution for forming a protective layer onto the photosensitive layer (for example, a charge transport layer), include common methods such as a dip coating method, a lift coating method, a wire bar coating method, a spray coating method, a blade coating method, a knife coating method, and a curtain coating method.

The thickness of the protective layer is, for example, set within the range of 1 μm or more and 20 μm or less and preferably 2 μm or more and 10 μm or less.

Image Forming Apparatus (and Process Cartridge)

An image forming apparatus according to an exemplary embodiment includes an electrophotographic photosensitive member, a charging unit that charges a surface of the electrophotographic photosensitive member, an electrostatic latent image forming unit that forms an electrostatic latent image on the surface of the electrophotographic photosensitive member in a charged state, a developing unit that forms a toner image by developing the electrostatic latent image on the surface of the electrophotographic photosensitive member by using a developer containing a toner, and a transfer unit that transfers the toner image onto a surface of a recording medium. The electrophotographic photosensitive member of the aforementioned exemplary embodiment is used as the electrophotographic photosensitive member.

The image forming apparatus of this exemplary embodiment is applicable to commonly used image forming apparatuses such as follows: an apparatus equipped with a fixing unit that fixes the toner image transferred onto the surface of the recording medium; a direct-transfer-type apparatus that directly transfers the toner image formed on the surface of the electrophotographic photosensitive member onto the recording medium; an intermediate-transfer-type apparatus that transfers the toner image formed on the surface of the electrophotographic photosensitive member onto a surface of an intermediate transfer body (first transfer) and then transfers the toner image on the surface of the intermediate transfer body onto a surface of the recording medium (second transfer); an apparatus equipped with a cleaning unit that cleans the surface of the electrophotographic photosensitive member after the transfer of the toner image and before charging; an apparatus equipped with a charge erasing unit that applies charge erasing light onto the surface of the electrophotographic photosensitive member after the transfer of the toner image and before charging; and an apparatus equipped with a member that heats the electrophotographic photosensitive member in order to increase the temperature of the electrophotographic photosensitive member and decrease the relative temperature.

According to the intermediate-transfer-type apparatus, the transfer unit includes an intermediate transfer body having a surface onto which a toner image is transferred, a first transfer unit that transfers the toner image on the surface of the electrophotographic photosensitive member onto a surface of the intermediate transfer body, and a second transfer unit that transfers the toner image on the surface of the intermediate transfer body onto a surface of a recording medium.

The image forming apparatus of this exemplary embodiment may be a dry-development type image forming apparatus or a wet-development type image forming apparatus (development is conducted by using a liquid developer).

In the image forming apparatus of this exemplary embodiment, for example, the portion equipped with an electrophotographic photosensitive member may have a cartridge structure (process cartridge) detachably attachable to the image forming apparatus. An example of the process cartridge is a process cartridge that includes the electrophotographic photosensitive member of the exemplary embodiment. The process cartridge may include, in addition to the electrophotographic photosensitive member, at least one selected from the group consisting of a charging unit, an electrostatic latent image forming unit, a developing unit, and a transfer unit.

A non-limiting example of the image forming apparatus of the exemplary embodiment is described below. The components illustrated in the drawings are described, and the descriptions of other components not illustrated in the drawings are omitted.

Figure 4:
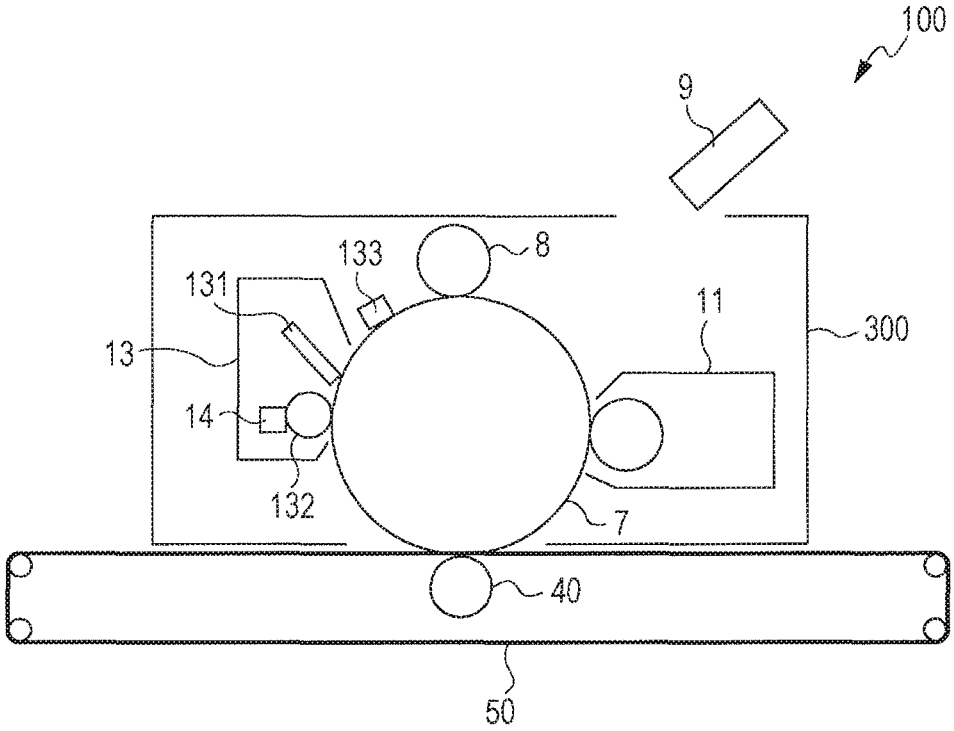
FIG. 4 is a schematic view of an image forming apparatus according to an exemplary embodiment.

FIG. 4 is a schematic diagram illustrating an example of the image forming apparatus of the exemplary embodiment. Referring to FIG. 4, an image forming apparatus 100 of the exemplary embodiment includes a process cartridge 300 that includes an electrophotographic photosensitive member 7, an exposing device 9 (an example of an electrostatic latent image forming unit), a transfer device 40 (first transfer device), and an intermediate transfer body 50. In the image forming apparatus 100, the exposing device 9 is located at a position such that the exposing device 9 applies light to the electrophotographic photosensitive member 7 through an opening in the process cartridge 300. The transfer device 40 is located at a position such that the transfer device 40 opposes the electrophotographic photosensitive member 7 with the intermediate transfer body 50 therebetween. The intermediate transfer body 50 is arranged so that a part of the intermediate transfer member 50 contacts the electrophotographic photosensitive member 7. Although not illustrated in the drawing, a second transfer device that transfers the toner image on the intermediate transfer body 50 onto a recording medium (for example, paper sheet) is also provided. The intermediate transfer body 50, the transfer device 40 (first transfer device), and the second transfer device (not illustrated in the drawing) correspond to examples of the transfer unit.

The process cartridge 300 illustrated in FIG. 4 integrally supports the electrophotographic photosensitive member 7, a charging device 8 (an example of a charging unit), a developing device 11 (an example of a developing unit), and a cleaning device 13 (an example of a cleaning unit) in the housing. The cleaning device 13 includes a cleaning blade (an example of a cleaning member) 131, and the cleaning blade 131 is arranged to make contact with a surface of the electrophotographic photosensitive member 7. The cleaning member may be a conductive or insulating fibrous member instead of the cleaning blade 131. The conductive or insulating fibrous member may be used alone or in combination with the cleaning blade 131.

FIG. 4 illustrates an example of the image forming apparatus that includes a fibrous member 132 (roll shape) that supplies a lubricant 14 onto the surface of the electrophotographic photosensitive member 7, and a fibrous member 133 (flat brush shape) that assists cleaning. These parts are arranged as needed.

Individual components of the image forming apparatus of the exemplary embodiment will now be described.

Charging Device

Examples of the charging device 8 include contact-type chargers that use conductive or semi-conductive charging rollers, charging brushes, charging films, charging rubber blades, and charging tubes; and non-contact-type chargers known in the art such as non-contact-type roller chargers and scorotron chargers and corotron chargers that use corona discharge.

Exposing Device

An example of the exposing device 9 is an optical device that illuminates the surface of the electrophotographic photosensitive member 7 by light from a semiconductor laser, an LED, or a liquid crystal shutter so as to form an intended light image on the surface. The wavelength of the light source is to be within the region of the spectral sensitivity of the electrophotographic photosensitive member. The mainstream semiconductor lasers are infrared lasers having an oscillation wavelength around 780 nm. The wavelength is not limited to this, and a laser that has an oscillation wavelength on the order of 600 nm or a blue laser that has an oscillation wavelength of 400 nm or more and 450 nm or less may also be used. A surface-emission type laser light source capable of outputting a multibeam is effective for forming color images.

Developing Device

An example of the developing device 11 is a typical developing device that conducts development by using a developer in a contact or non-contact manner. The developing device 11 may be any device that has this function and is selected according to the purpose. An example thereof is a known developing device that has a function of causing a one-component or two-component developer to attach to the electrophotographic photosensitive member 7 by using a brush, a roller, or the like. In particular, the developing device may use a development roller that retains the developer on the surface thereof.

The developer used in the developing device 11 may be a one-component developer formed of a toner alone or may be a two-component developer formed of a toner and a carrier. The developer may be magnetic or non-magnetic. Known developers may be used as the developer.

Cleaning Device

A cleaning blade-type device equipped with the cleaning blade 131 is used as the cleaning device 13. A fur brush cleaning technique or a technique of performing development and cleaning simultaneously may be employed instead of or in addition to the cleaning blade.

Transfer Device

Examples of the transfer device 40 include contact-type transfer chargers that use belts, rollers, films, rubber blades, etc., and scorotron transfer chargers and corotron transfer chargers that use corona discharge known in the art.

Intermediate Transfer Body

The intermediate transfer body 50 may be a belt-shaped member (intermediate transfer belt) that contains a polyimide, a polyamideimide, a polycarbonate, a polyarylate, a polyester, rubber, or the like that is made semi-conductive. The intermediate transfer body may have a drum shape instead of the belt shape.

Figure 5:
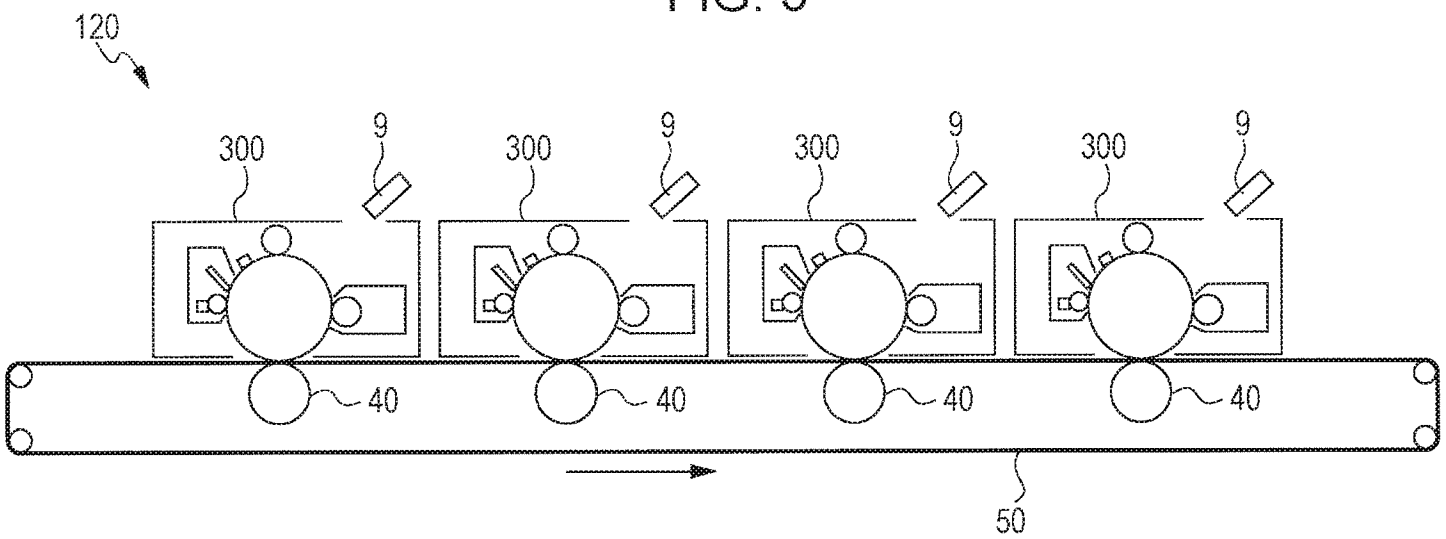
FIG. 5 is a schematic view of an image forming apparatus according to another exemplary embodiment.

FIG. 5 is a schematic diagram illustrating another example of the image forming apparatus of the exemplary embodiment. An image forming apparatus 120 illustrated in FIG. 5 is a multi-color image forming apparatus of a tandem-type equipped with four process cartridges 300. In the image forming apparatus 120, four process cartridges 300 are arranged side-by-side on the intermediate transfer body 50. One electrophotographic photosensitive member is used for one color. The image forming apparatus 120 has the same structure as the image forming apparatus 100 except for that the image forming apparatus 120 is of a tandem type.

The structure of the image forming apparatus 100 is not limited to one described above. For example, a first charge erasing device that makes the polarity of the residual toner uniform so that the residual toner may be easily removed may be provided around the electrophotographic photosensitive member 7, on the downstream side of the transfer device 40 in the electrophotographic photosensitive member 7 rotation direction and on the upstream side of the cleaning device 13 in the electrophotographic photosensitive member rotating direction. Alternatively, a second charge erasing device that erases charges from the surface of the electrophotographic photosensitive member 7 may be provided on the downstream side of the cleaning device 13 in the electrophotographic photosensitive member rotating direction and on the upstream side of the charging device 8 in the electrophotographic photosensitive member rotating direction.

The structure of the image forming apparatus 100 is not limited to one described above and may be, for example, any known direct-transfer-type image forming apparatus that directly transfers a toner image on the electrophotographic photosensitive member 7 onto a recording medium.

EXAMPLES

The exemplary embodiments will now be specifically described by way of examples which do not limit the scope of the exemplary embodiments. In the examples below, "parts" means parts by weight unless otherwise noted.

Preparation of Electrophotographic Photosensitive Member

Example 1

A coating solution A for forming a photosensitive layer is prepared by dissolving 50 parts by weight of a bisphenol Z polycarbonate resin (viscosity-average molecular weight: 50,000) serving as a binder resin and 40 parts by weight of a hole transport material indicated in Table 1 in 250 parts by weight of tetrahydrofuran and 250 parts by weight of toluene.

A mixture containing 1.5 parts by weight of a type V hydroxygallium phthalocyanine pigment, which serves as the charge generation material, at least having diffraction peaks at Bragg angles (2θ±0.2°) of 7.3°, 16.0°, 24.9°, and 28.0° in a X-ray diffraction spectrum taken with a Cukα characteristic X-ray, 50 parts by weight of a bisphenol Z polycarbonate resin (viscosity-average molecular weight: 50,000) serving as a binder resin, 10 parts by weight of an electron transport material indicated in Table 1, 37 parts by weight of a hole transport material indicated in Table 1, 5 parts by weight of a polytetrafluoroethylene resin particles (volume-average particle size: 200 nm) serving as fluororesin particles, and 250 parts by weight of tetrahydrofuran and 250 parts by weight of toluene serving as solvents is dispersed for 4 hours in a DYNO MILL using glass beads 1 mm in diameter. As a result, a coating solution B1 for forming a photosensitive layer is obtained.

A conductive base (made of aluminum) is loaded onto an inkjet film forming device having a structure illustrated in FIG. 3. The coating solution A for forming a photosensitive layer is charged into the second droplet discharge unit 200B, and a coating solution B1 for forming a photosensitive layer is charged into the first droplet discharge unit 200A (the third droplet discharge unit 200C in FIG. 3 is not used). The coating solutions A and B1 for forming a photosensitive layer charged into the second droplet discharge units 200B and 200A are ejected from the nozzles 202 toward the conductive base under the conditions described below. Then the solutions are dried at 140° C. for 30 minutes to form a single-layer-type photosensitive layer having a thickness of 30 μm. The resulting product is assumed to be a photosensitive member 1 of Example 1.

According to the inkjet film-forming device described above, the coating solutions are supplied by using pumps, and droplets are formed by vibrating piezoelectric elements disposed in the droplet discharge units and are continuously ejected. The device configuration and the application conditions are as follows. The device configuration of each droplet discharge unit is the same. Moreover, the ejection conditions under which the coating solution are ejected from the nozzles of the second droplet discharge unit 200B and the first droplet discharge unit 200A are the same in all of Examples.

Inkjet nozzle inner diameter: 12.5 μm
Nozzle arrangement/number of nozzles: serial/7
Nozzle-to-nozzle distance: 0.5 mm
Nozzle-to-drum distance: 1 mm
Tilt angle: 80°
Frequency of piezoelectric element: 75 kHz
Frequency of plunger pump: 5.58 Hz
Drum rotating speed: 715 rpm

Examples 2 to 11 and Comparative Examples 3 to 6

Photosensitive members 2 to 11 of Examples 2 to 11 and photosensitive members C3 to C6 of Comparative Examples 3 to 6 are prepared as in Example 1 except that the photosensitive layer is formed by using coating solutions B and C for forming a photosensitive layer prepared by changing the amount of the charge generation material, the type and amount of the electron transport material, the type of the hole transport material, and the type and amount of the fluororesin particles as indicated in Tables 1 and 2.

Comparative Example 1

A mixture containing 1.5 parts by weight of a type V hydroxygallium phthalocyanine pigment, which serves as the charge generation material, at least having diffraction peaks at Bragg angles (2θ±0.2°) of 7.3°, 16.0°, 24.9°, and 28.0° in an X-ray diffraction spectrum taken with a Cukα characteristic X-ray, 50 parts by weight of a bisphenol Z polycarbonate resin (viscosity-average molecular weight: 50,000) serving as a binder resin, 10 parts by weight of the electron transport material indicated in Table 2, 37 parts by weight of the hole transport material indicated in Table 2, 5 parts by weight of polytetrafluoroethylene resin particles (volume-average particle size: 200 nm) serving as fluororesin particles, and 250 parts by weight of tetrahydrofuran and 50 parts by weight of toluene serving as solvents is dispersed in a DYNO MILL for 4 hours using glass beads 1 mm in diameter. As a result, a coating solution C1 for forming a photosensitive layer is obtained.

The coating solution C1 for forming a photosensitive layer is applied onto a conductive base (aluminum base) by a dip coating method, and dried at 140° C. for 30 minutes to conduct curing and obtain a single-layer-type photosensitive layer having a thickness of 30 μm. As a result, a photosensitive member C1 of Comparative Example 1 is obtained.

Comparative Example 2

A photosensitive member C2 of Comparative Example 2 is prepared as in Comparative Example 1 except that the photosensitive layer is formed by using a coating solution C2 for forming a photosensitive layer prepared by changing the amount of fluororesin particles.

Evaluation

The electrophotographic photosensitive members obtained in the respective examples are evaluated. The results are indicated in the tables.

Distribution of Charge Generation Material, Fluorine-containing Electron Transport Material, and Fluororesin Particles For each of the photosensitive layers obtained in the examples, the values given by formulae indicating the distribution of the charge generation material, the fluorine-containing electron transport material, and the fluororesin particles (formula indicating the distribution of the charge generation material: a/b, formula indicating the distribution of the electron transport material: c/d, and the formula indicating the distribution of the fluororesin particles: e/f) in the thickness direction of the photosensitive layer are obtained by the aforementioned method. The results are indicated in Tables 3 and 4.

Evaluation of Sensitivity of Photosensitive Member

The sensitivity of the photosensitive member is evaluated in terms of a half-decay exposure with an initial charging of +800 V. Specifically, after the photosensitive member is charged to +800 V in a 20° C., 40% RH environment by using an electrostatic copying paper tester (electrostatic analyzer EPA-8100 produced by Kawaguchi Electric Works), 800 nm monochromatic light obtained from tungsten lamp light by using a monochromator is applied to the photosensitive member so that the intensity of the light is 1 $\mu W/cm^2$ at the surface of the photosensitive member.

The half-decay exposure $E_{1/2}$ ($\mu J/cm^2$) at which the surface potential of the photosensitive member reaches ½×V0 (V) by irradiation where V0 represents a surface potential (V) of the surface of the photosensitive member immediately after charging is measured.

The photosensitive member is evaluated as having high sensitivity when a half-decay exposure of 0.2 $\mu J/cm^2$ or less is obtained. The results are indicated in Tables 5 and 6.

Evaluation Standard:
A: 0.2 μJ/cm$^2$ or less
B: more than 0.2 μJ/cm$^2$

Evaluation of Chargeability of Photosensitive Member

The chargeability of the photosensitive member is evaluated in terms of electrical conductivity σ [1/Ω·cm] measured by DC I-V measurement under dark conditions.

A measurement sample for chargeability evaluation is prepared by sputter-depositing gold (Au) (triplet electrode area: 0.93 cm$^2$) on the surface of the photosensitive member. Voltage is applied stepwise with the gold side set to plus, and the current value during the voltage application is measured to determine the electrical conductivity at 27 V/μm.

The photosensitive member is evaluated as having high chargeability when σ is $1.0\times10^{-13}$ [1/Ω·cm] or less. The results are indicated in Tables 5 and 6.

Evaluation Standards:
A: $1.0\times10^{-13}$ [1/Ω·cm] or less
B: more than $1.0\times10^{-13}$ [1/Ω·cm]

Evaluation of Residual Potential of Photosensitive Member

The surface of a photosensitive member charged to +600 V with a scorotron charger is scanned by exposure light (light source: semiconductor laser, wavelength: 780 nm, output: 5 mW). Then the potential of the photosensitive member is measured with a surface potentiometer (Model 344 produced by Trek Japan Co., Ltd.) and the potential state (residual potential) of the photosensitive member is investigated. The results are indicated in Tables 5 and 6.

Evaluation Standards:
A: 60 [V] or less
B: more than 60 [V] but not more than 120 [V]
C: more than 120 [V]

TABLE 1

| | | | Coating solution A | | | Coating solution B | | | | | | | | |
|---|---|---|---|---|---|---|---|---|---|---|---|---|---|---|
| | | | Hole transport material | | Solvent THF | Charge generation material | | Electron transport material | | Hole transport material | | Fluororesin particles | | |
| | Photosensitive member No. | Application method | Type | Parts by weight | parts by weight | Type | Parts by weight | Type | Parts by weight | Type | Parts by weight | Type | Parts by weight | Solvent |
| Example 1 | Photosensitive member 1 | IJ | HTM-1 | 40 | 250 | CGM-1 | 1.5 | ETM-1 | 10 | HTM-1 | 37 | PTFE | 5 | THF/Tol |
| Example 2 | Photosensitive member 2 | IJ | HTM-1 | 40 | 250 | CGM-1 | 1.5 | ETM-1 | 10 | HTM-1 | 37 | PTFE | 10 | THF/Tol |
| Example 3 | Photosensitive member 3 | IJ | HTM-1 | 40 | 250 | CGM-1 | 1.5 | ETM-1 | 15 | HTM-1 | 37 | PTFE | 5 | THF/Tol |
| Example 4 | Photosensitive member 4 | IJ | HTM-1 | 40 | 250 | CGM-1 | 1.5 | ETM-1 | 15 | HTM-1 | 37 | PTFE | 10 | THF/Tol |
| Example 5 | Photosensitive member 5 | IJ | HTM-1 | 40 | 250 | CGM-1 | 4.5 | ETM-1 | 10 | HTM-1 | 37 | PTFE | 5 | THF/Tol |
| Example 6 | Photosensitive member 6 | IJ | HTM-1 | 40 | 250 | CGM-1 | 4.5 | ETM-1 | 15 | HTM-1 | 37 | PTFE | 10 | THF/Tol |
| Example 7 | Photosensitive member 7 | IJ | HTM-2 | 40 | 250 | CGM-1 | 1.5 | ETM-1 | 10 | HTM-2 | 37 | PTFE | 5 | THF/Tol |
| Example 8 | Photosensitive member 8 | IJ | HTM-2 | 40 | 250 | CGM-1 | 1.5 | ETM-1 | 10 | HTM-2 | 37 | PTFE | 10 | THF/Tol |
| Example 9 | Photosensitive member 9 | IJ | HTM-2 | 40 | 250 | CGM-1 | 1.5 | ETM-1 | 15 | HTM-2 | 37 | PTFE | 5 | THF/Tol |
| Example 10 | Photosensitive member 10 | IJ | HTM-2 | 40 | 250 | CGM-1 | 1.5 | ETM-1 | 15 | HTM-2 | 37 | PTFE | 10 | THF/Tol |
| Example 11 | Photosensitive member 11 | IJ | HTM-1 | 40 | 250 | CGM-1 | 1.5 | ETM-1 | 45 | HTM-1 | 37 | PTFE | 5 | THF/Tol |

TABLE 2

| | | | Coating solution A | | | Coating solution C | | | | | | | | |
|---|---|---|---|---|---|---|---|---|---|---|---|---|---|---|
| | | | Hole transport material | | Solvent THF | Charge generation material | | Electron transport material | | Hole transport material | | Fluororesin particles | | |
| | Photosensitive member No. | Application method | Type | Parts by weight | parts by weight | Type | Parts by weight | Type | Parts by weight | Type | Parts by weight | Type | Parts by weight | Solvent |
| Comparative Example 1 | Photosensitive member C1 | Dip coating | — | — | — | CGM-1 | 1.5 | ETM-1 | 10 | HTM-1 | 37 | PTFE | 5 | THF/Tol |

TABLE 2-continued

| | Photo-sensitive member No. | Application method | Coating solution A: Hole transport material Type | Coating solution A: Hole transport material Parts by weight | Coating solution A: Solvent THF parts by weight | Coating solution C: Charge generation material Type | Coating solution C: Charge generation material Parts by weight | Coating solution C: Electron transport material Type | Coating solution C: Electron transport material Parts by weight | Coating solution C: Hole transport material Type | Coating solution C: Hole transport material Parts by weight | Coating solution C: Fluororesin particles Type | Coating solution C: Fluororesin particles Parts by weight | Coating solution C: Solvent |
|---|---|---|---|---|---|---|---|---|---|---|---|---|---|---|
| Comparative Example 2 | Photo-sensitive member C2 | Dip coating | — | — | — | CGM-1 | 1.5 | ETM-1 | 10 | HTM-1 | 37 | PTFE | 10 | THF/Tol |
| Comparative Example 3 | Photo-sensitive member C3 | IJ | HTM-1 | 40 | 250 | CGM-1 | 1.5 | ETM-2 | 10 | HTM-1 | 37 | PTFE | 10 | THF/Tol |
| Comparative Example 4 | Photo-sensitive member C4 | IJ | HTM-1 | 40 | 250 | CGM-1 | 4.5 | ETM-2 | 15 | HTM-1 | 37 | PTFE | 5 | THF/Tol |
| Comparative Example 5 | Photo-sensitive member C5 | IJ | HTM-1 | 40 | 250 | CGM-1 | 9 | ETM-1 | 10 | HTM-1 | 37 | PTFE | None | THF/Tol |
| Comparative Example 6 | Photo-sensitive member C6 | IJ | HTM-1 | 40 | 250 | CGM-1 | 15 | ETM-1 | 15 | HTM-1 | 37 | PTFE | None | THF/Tol |

TABLE 3

| | Photo-sensitive member No. | Application method | Distribution of charge generation material: Amount relative to entire photosensitive layer Weight % | a (n3 average) Integral area | b (n3 average) Integral area | a/b | Distribution of electron transport material: c (n3 average) Integral area | d (n3 average) Integral area | c/d | Distribution of fluororesin particles: e (n3 average) Particles/$\mu m^2$ | f (n3 average) Particles/$\mu m^2$ | e/f |
|---|---|---|---|---|---|---|---|---|---|---|---|---|
| Example 1 | Photo-sensitive member 1 | IJ | 0.5 | 29 | 0.95 | 30.5 | 250 | 8.2 | 30.5 | 13 | 0.3 | 43.3 |
| Example 2 | Photo-sensitive member 2 | IJ | 0.5 | 29 | 0.95 | 30.5 | 250 | 8.2 | 30.5 | 30 | 0.5 | 60.0 |
| Example 3 | Photo-sensitive member 3 | IJ | 0.5 | 29 | 0.95 | 30.5 | 250 | 8.2 | 30.5 | 12.8 | 0.2 | 64.0 |
| Example 4 | Photo-sensitive member 4 | IJ | 0.5 | 29 | 0.95 | 30.5 | 250 | 8.2 | 30.5 | 31.2 | 0.5 | 62.4 |
| Example 5 | Photo-sensitive member 5 | IJ | 1.5 | 87 | 1.2 | 72.5 | 250 | 8.2 | 30.5 | 12 | 0.3 | 40.0 |
| Example 6 | Photo-sensitive member 6 | IJ | 1.5 | 87 | 1.2 | 72.5 | 250 | 8.2 | 30.5 | 33.2 | 0.9 | 36.9 |
| Example 7 | Photo-sensitive member 7 | IJ | 0.5 | 29 | 0.95 | 30.5 | 250 | 8.2 | 30.5 | 11.5 | 0.3 | 38.3 |
| Example 8 | Photo-sensitive member 8 | IJ | 0.5 | 29 | 0.95 | 30.5 | 250 | 8.2 | 30.5 | 30.1 | 0.7 | 43.0 |
| Example 9 | Photo-sensitive member 9 | IJ | 0.5 | 29 | 0.95 | 30.5 | 250 | 8.2 | 30.5 | 13.5 | 0.3 | 45.0 |
| Example 10 | Photo-sensitive member 10 | IJ | 0.5 | 29 | 0.95 | 30.5 | 250 | 8.2 | 30.5 | 29.8 | 0.5 | 59.6 |
| Example 11 | Photo-sensitive member 11 | IJ | 0.5 | 29 | 0.95 | 30.5 | 740 | 8.7 | 85.1 | 13 | 0.3 | 43.3 |

TABLE 4

| | | | Distribution of charge generation material | | | | Distribution of electron transport material | | | Distribution of fluororesin particles | | |
|---|---|---|---|---|---|---|---|---|---|---|---|---|
| | Photo-sensitive member No. | Appli-cation method | Amount relative to entire photosensitive layer Weight % | a (n3 average) Integral area | b (n3 average) Integral area | a/b | c (n3 average) Integral area | d (n3 average) Integral area | c/d | e (n3 average) Particles/ $\mu m^2$ | f (n3 average) Particles/ $\mu m^2$ | e/f |
| Comparative Example 1 | Photo-sensitive member C1 | Dip coating | 0.5 | 16 | 15 | 1.1 | 151 | 148 | 1.0 | 7.5 | 7.5 | 1.0 |
| Comparative Example 2 | Photo-sensitive member C2 | Dip coating | 0.5 | 16 | 15 | 1.1 | 151 | 148 | 1.0 | 15.2 | 15.1 | 1.0 |
| Comparative Example 3 | Photo-sensitive member C3 | IJ | 0.5 | 29 | 0.95 | 30.5 | 151 | 148 | 1.0 | 15.1 | 0.5 | 30.2 |
| Comparative Example 4 | Photo-sensitive member C4 | IJ | 1.5 | 87 | 2.9 | 30.0 | 151 | 148 | 1.0 | 7.7 | 0.2 | 38.5 |
| Comparative Example 5 | Photo-sensitive member C5 | IJ | 3 | 105 | 3.4 | 30.9 | 151 | 148 | 1.0 | 0 | 0 | — |
| Comparative Example 6 | Photo-sensitive member C6 | IJ | 5 | 285 | 9.3 | 30.6 | 151 | 148 | 1.0 | 0 | 0 | — |

TABLE 5

| | | Sensitivity | | Chargeability | | Residual potential | |
|---|---|---|---|---|---|---|---|
| | Photosensitive member No. | $E_{1/2}$ [$\mu J/cm^2$] | Rating | σ [1/Ω · cm] | Rating | [V] | Rating |
| Example 1 | Photosensitive member 1 | 0.18 | A | $3.25 \times 10^{-14}$ | A | 41 V | A |
| Example 2 | Photosensitive member 2 | 0.18 | A | $3.15 \times 10^{-14}$ | A | 42 V | A |
| Example 3 | Photosensitive member 3 | 0.18 | A | $3.25 \times 10^{-14}$ | A | 40 V | A |
| Example 4 | Photosensitive member 4 | 0.18 | A | $2.54 \times 10^{-14}$ | A | 41 V | A |
| Example 5 | Photosensitive member 5 | 0.18 | A | $4.79 \times 10^{-14}$ | A | 40 V | A |
| Example 6 | Photosensitive member 6 | 0.18 | A | $3.56 \times 10^{-14}$ | A | 41 V | A |
| Example 7 | Photosensitive member 7 | 0.18 | A | $3.45 \times 10^{-14}$ | A | 40 V | A |
| Example 8 | Photosensitive member 8 | 0.18 | A | $3.35 \times 10^{-14}$ | A | 42 V | A |
| Example 9 | Photosensitive member 9 | 0.18 | A | $5.6 \times 10^{-14}$ | A | 40 V | A |
| Example 10 | Photosensitive member 10 | 0.18 | A | $4.75 \times 10^{-14}$ | A | 43 V | A |
| Example 11 | Photosensitive member 11 | 0.18 | A | $2.54 \times 10^{-14}$ | A | 40 V | A |

TABLE 6

| | | Sensitivity | | Chargeability | | Residual potential | |
|---|---|---|---|---|---|---|---|
| | Photosensitive member No. | $E_{1/2}$ [$\mu J/cm^2$] | Rating | σ [1/Ω · cm] | Rating | [V] | Rating |
| Comparative Example 1 | Photosensitive member C1 | 0.25 | B | $1.63 \times 10^{-13}$ | B | 121 V | C |
| Comparative Example 2 | Photosensitive member C2 | 0.19 | A | $5.20 \times 10^{-13}$ | B | 122 V | C |
| Comparative Example 3 | Photosensitive member C3 | 0.18 | A | $3.25 \times 10^{-13}$ | B | 121 V | C |
| Comparative Example 4 | Photosensitive member C4 | 0.18 | A | $2.94 \times 10^{-13}$ | B | 62 V | B |
| Comparative Example 5 | Photosensitive member C5 | 0.18 | A | $2.95 \times 10^{-13}$ | B | 120 V | C |
| Comparative Example 6 | Photosensitive member C6 | 0.18 | A | $2.25 \times 10^{-13}$ | B | 63 V | B |

The above-described results demonstrate that better results are obtained from Examples than from Comparative Examples in terms of residual potential of the photosensitive member.

Abbreviations used in Tables 1 and 2 are as follows:

IJ: inkjet coating method

CGM-1: type V hydroxygallium phthalocyanine pigment at least having diffraction peaks at Bragg angles (2θ±0.2°) of 7.3°, 16.0°, 24.9°, and 28.0° in an X-ray diffraction spectrum taken using a CuKα characteristic X-ray ETM-1: Example Compound "b-1-1" of an electron transport material represented by structural formula (b-1) (9-dicyanomethylene-9-fluorenone-4-carboxylic acid perfluorooctyl)

ETM-2: 3,3'-di-tert-pentyl-dinaphthoquinone

HTM-1: N,N'-diphenyl-N,N'-bis(3-methylphenyl)-1,1'-biphenyl-4,4'-diamine

HTM-2: 4-(2,2-diphenylethenyl)-N,N'-bis(4-methylphenyl) benzenamine

PTFE: polytetrafluoroethylene resin particles

THF: tetrahydrofuran

Tol: toluene

What is claimed is:

1. An electrophotographic photosensitive member comprising:

a conductive base; and a single-layer photosensitive layer on the conductive base, the photosensitive layer containing:

a binder resin, a charge generation material, a hole transport material, a fluorine-atom-containing electron transport material, and fluorine-atom-containing resin particles, wherein:

an amount of the charge generation material in the photosensitive layer is 0.5% by weight or more and less than 2.0% by weight, the charge generation material has a distribution that satisfies formula (1) in a thickness direction of the photosensitive layer:

$$30 \leq a/b \qquad \text{Formula (1):}$$

where a represents a concentration of the charge generation material in a region extending ⅓ of a thickness of the photosensitive layer from a surface side of the photosensitive layer, and b represents a concentration of the charge generation material in a region extending ⅔ of the thickness of the photosensitive layer from a conductive-base side of the photosensitive layer and may be 0, and the fluorine-atom-containing electron transport material has a distribution that satisfies formula (2) in the thickness direction of the photosensitive layer:

$$30 \leq c/d \qquad \text{Formula (2):}$$

where c represents a concentration of the fluorine-atom-containing electron transport material in the region extending ⅓ of the thickness of the photosensitive layer from the surface side of the photosensitive layer, and d represents a concentration of the fluorine-atom-containing electron transport material in the region extending ⅔ of the thickness of the photosensitive layer from the conductive-base side of the photosensitive layer and may be 0.

2. The electrophotographic photosensitive member according to claim 1, wherein the fluorine-atom-containing resin particles have a distribution that satisfies formula (3) in the thickness direction of the photosensitive layer:

$$30 \leq e/f \qquad \text{Formula (3):}$$

where e represents the number of the fluorine-atom-containing resin particles per unit cross-sectional area in the region extending ⅓ of the thickness of the photosensitive layer from the surface side of the photosensitive layer, and f represents the number of the fluorine-atom-containing resin particles per unit cross-sectional area in the region extending ⅔ of the thickness of the photosensitive layer from the conductive-base side of the photosensitive layer and may be 0.

3. The electrophotographic photosensitive member according to claim 1, wherein b is 0.

4. The electrophotographic photosensitive member according to claim 1, wherein d is 0.

5. The electrophotographic photosensitive member according to claim 1, wherein the fluorine-atom-containing electron transport material is a fluorenone compound having a fluorine atom.

6. The electrophotographic photosensitive member according to claim 5, wherein the fluorenone compound having a fluorine atom is a fluorenone compound having a fluoroalkyl group.

7. The electrophotographic photosensitive member according to claim 6, wherein the fluorenone compound having a fluoroalkyl group is a fluorenone compound having a fluoroalkyl ester group.

8. A process cartridge detachably attachable to an image forming apparatus, comprising:

the electrophotographic photosensitive member according to claim 1.

9. An image forming apparatus comprising:

the electrophotographic photosensitive member according to claim 1;

a charging unit that charges a surface of the electrophotographic photosensitive member;

an electrostatic latent image forming unit that forms an electrostatic latent image on the surface of the electrophotographic photosensitive member in a charged state;

a developing unit that develops the electrostatic latent image on the surface of the electrophotographic photosensitive member by using a developer containing a toner so as to form a toner image; and a transfer unit that transfers the toner image onto a surface of a recording medium.

* * * * *